US006618237B2

(12) United States Patent
Eddy et al.

(10) Patent No.: US 6,618,237 B2
(45) Date of Patent: Sep. 9, 2003

(54) SYSTEM FOR THE INITIATION OF ROUNDS OF INDIVIDUALLY DELAYED DETONATORS

(75) Inventors: Christopher L. Eddy, McCandless, PA (US); Rajeev N. Singhal, Pittsburgh, PA (US)

(73) Assignee: Senex Explosives, Inc., Cuddy, PA (US)

( * ) Notice: Subject to any disclaimer, the term of this patent is extended or adjusted under 35 U.S.C. 154(b) by 0 days.

(21) Appl. No.: 10/165,174

(22) Filed: Jun. 6, 2002

(65) Prior Publication Data

US 2003/0029344 A1 Feb. 13, 2003

Related U.S. Application Data

(60) Provisional application No. 60/296,236, filed on Jun. 6, 2001.

(51) Int. Cl.[7] ..... F23Q 7/02; F42D 1/06

(52) U.S. Cl. ..... 361/249; 361/247; 361/254; 102/276; 102/275.5; 102/217

(58) Field of Search ..... 361/249, 254, 361/247; 102/217, 275.9, 276

(56) References Cited

U.S. PATENT DOCUMENTS

| | | | | |
|---|---|---|---|---|
| 2,411,339 A | * 11/1946 | Rolfes et al. | ..... | 102/206 |
| 4,145,970 A | 3/1979 | Hedberg et al. | ..... | 102/218 |
| 4,297,947 A | 11/1981 | Jones et al. | ..... | 361/248 |
| 4,311,096 A | 1/1982 | Oswald | ..... | 102/202.13 |
| 4,324,182 A | 4/1982 | Kirby et al. | ..... | 102/217 |
| 4,409,897 A | 10/1983 | Kirby et al. | ..... | 102/200 |
| 4,425,849 A | 1/1984 | Jorgenson | ..... | 102/275.12 |
| 4,586,437 A | 5/1986 | Miki et al. | ..... | 102/220 |
| 4,601,243 A | 7/1986 | Ueda et al. | ..... | 102/200 |
| 4,646,640 A | 3/1987 | Florin et al. | ..... | 102/217 |
| 4,674,047 A | 6/1987 | Tyler et al. | ..... | 364/423 |
| 4,782,911 A | 11/1988 | Dixon et al. | | |
| 4,860,653 A | 8/1989 | Abouav | ..... | 102/200 |
| 4,893,564 A | 1/1990 | Ochi et al. | ..... | 102/218 |
| 5,189,246 A | 2/1993 | Marsh et al. | ..... | 102/217 |
| 5,214,236 A | 5/1993 | Murphy et al. | ..... | 102/217 |
| 5,282,421 A | 2/1994 | Marsh et al. | ..... | 102/217 |
| 5,295,438 A | 3/1994 | Hill et al. | ..... | 102/217 |
| 5,406,890 A | 4/1995 | Marsh et al. | ..... | 102/217 |
| 5,460,093 A | 10/1995 | Prinz et al. | ..... | 102/217 |
| 5,520,114 A | 5/1996 | Guimard et al. | ..... | 102/215 |
| 5,602,713 A | 2/1997 | Kurogi et al. | ..... | 361/249 |
| 5,912,428 A | 6/1999 | Patti | | |

* cited by examiner

*Primary Examiner*—Kim Huynh
(74) *Attorney, Agent, or Firm*—Webb Ziesenheim Logsdon Orkin & Hanson, P.C.

(57) ABSTRACT

Disclosed is an electronic detonator delay assembly, having an associated detonator, that can be pre-programmed on site with a time delay and installed in a borehole to carryout a blast operation. The assembly is first coupled to a programming unit to program the desired time delay, and then to a blasting unit, by means of a magnetic coupling device in the electronic delay assembly and to a single pass of a conductive wire through the magnetic coupling device. The programmed time delay in the electronic delay assembly can be double checked through a wireless communication link between the electronic delay assembly and the programming unit.

22 Claims, 16 Drawing Sheets

SYSTEM FOR THE INITIATION OF ROUNDS OF INDIVIDUALLY DELAYED DETONATORS

CROSS REFERENCE TO RELATED APPLICATION

This application claims the benefit of United States Provisional Patent Application No. 60/296,236, filed Jun. 6, 2001.

BACKGROUND OF THE INVENTION

1. Field of the Invention

This invention relates to the detonation of an explosive device and, more particularly, to the control of a plurality of detonators having varying detonation delays.

2. Description of Related Art

In the blasting of rock in mining, quarrying or construction operations, it is necessary to place discrete explosive charges within boreholes drilled within the mass of the rock, such that the detonation of each individual charge can act effectively on the rock to both fracture and move the rock, without producing levels of vibration in the surrounding rock sufficient to cause damage or nuisance to an adjacent property. It is, therefore, necessary to utilize an array of blasting caps or detonators, with one or more plates within each individual charge such that each charge fires in a pre-determined sequence and with such a time delay interval between other charges that they fire independently of each other.

At present, it is common to use blasting caps (detonators) with different delay periods produced by the burning of pyrotechnic delay elements of various lengths and with varying compositions such that the time between the blasting cap receiving a firing signal and the detonation of the base charge can be determined during manufacture within certain tolerances. Such initiation systems have several problems associated with them. Since different detonation delays are required, it is common to provide a large number of blasting caps (detonators) with different time delays. For example, thirty detonation delays, in 25 or 30 msec increments, are common in the industry. The desired time delay is determined for each borehole and the detonator (blasting cap) possessing the desired time delay is installed in the borehole along with the charge. Moreover, the lead wires that connect the detonator to the top of the borehole are typically hard-wired to the detonator and the length of the lead wires must vary for the various depths of the boreholes. Ten or fifteen separate lead wire lengths are usually manufactured to meet the need of differing depths of boreholes. As a result, an installer must have available a multiplicity of detonators, up to 400 different versions or units, possessing the various combinations of available time delays and various lead wire lengths, and install a particular detonator (time delay/lead wire length) in each borehole. The inventory required of the various time delays/lead wire lengths for the various detonators is quite large. Moreover, lack of the correct delay time or lead wire length can result in the use of an inappropriate detonator to initiate a particular charge or group of charges. The delay timings are set during manufacture, which limits the scope of obtaining the most efficient or appropriate timing of the charges within a particular blast. Indeed, due to the limitations inherent in the manufacture of such pyrotechnic delays, blasting caps or detonators of the same nominal delay time can vary quite considerably. The effects of temperature, humidity, age, storage, and handling all contribute to degradation in the accuracy of the delay time actually produced at the time of actual detonation. This can result in out of sequence firing of the individual explosive charges, which can produce flyrock, poor fragmentation of rock, and/or high levels of ground vibration and air blast.

Electric blasting caps or detonators will initiate the detonation of an explosive charge if it is supplied with sufficient electrical energy from a source. Of necessity, the energy levels required are relatively low. Stray electrical energy from radio transmissions, static electrical build-up, earth leakage from faulty equipment and nearby lightning strikes have all been responsible for premature detonation of electric detonators. Non-electric systems have been used to overcome most of these problems, but they suffer from the drawback that it is impossible to test that the circuit is intact and correctly connected prior to attempting to fire the blast. Even with electric detonators it is impossible to check the functionality of the delay element. As a result, a small proportion of detonators will misfire, producing the hazardous situation where unexploded explosives remain hidden amongst the rock pile without anyone realizing that they are present.

Other means have been used to improve the safety and reliability of the electric delay detonator, including a transformer coupling which resulted in a much simplified method of connecting the detonators into the firing circuit while at the same time overcoming many of the problems due to stray electrical energy and current leakage. Devices known as the "Magnadet" detonator allowed for a significant reduction in inventory to be made by providing a system where lead wires could be coupled to a standard shot-length detonator unit in the field. See, for example, U.S. Pat. Nos. 4,297,947 and 4,425,849. However, the problems associated with delay time accuracy can only be addressed by moving away from traditional pyrotechnic delay systems.

Although not yet routinely applied in mining and quarrying operations, the use of electronically timed detonators does provide a solution to the problems of delay time accuracy and the ability for the blaster to determine the delay time of each unit. See, for example, U.S. Pat. Nos. 4,324,182; 4,409,897; 4,646,640; 5,189,246; 5,282,421; 5,406,890; 5,520,114; and 5,602,713. Although inventory levels are reduced due to the absence of pre-set or nominal delay periods, the requirement for manufactured lead wires of different length and/or special connectors creates new problems with stocking the correct components and having the skilled personnel available to correctly employ special connectors to provide a reliable electrically competent connection.

Other relevant patents include U.S. Pat. Nos. 5,460,093; 5,295,438; 5,214,236; 4,893,564; 4,860,653; 4,674,047; 4,601,243; 4,586,437; 4,311,096 and 4,145,970.

In summary, there is a need for improved timing accuracy of blasting caps or detonators together with a need for an ability to set the nominal delay time of each detonator appropriate to its location within the blast in order to obtain more controllable rock fragmentation and displacement and the reduction of undesirable ground vibrations. Also, in order to improve safety and reliability, it would be beneficial to minimize the susceptibility of electric blasting systems to extraneous electrical stimuli, while simplifying the connection of the devices into the blasting circuit, and being able to use standard, readily available cabling and connectors. Reliability could be further improved by being able to test the functionality of each blasting cap prior to it being incorporated into the blasting circuit. Ideally, a single programmable detonator or blasting cap with a simple, reliable means of connection into the blasting circuit would ensure that the most appropriately timed detonator will be correctly located within the blast, in order to provide the most efficient method of blasting. It would also be extremely cost-effective to reduce the detonator inventory to only one basic programmable detonator unit which can be connected into the blasting circuit, at any desired position, by reels of readily available standard insulated conductive wire.

SUMMARY OF THE INVENTION

Accordingly, we have developed an electronic delay assembly which can be connected to an explosive detonator and effect the firing of the detonator in a controlled manner. The electronic delay assembly in accordance with our invention includes a magnetic coupling device having an opening therein configured to receive a conductive wire extending therethrough. The magnetic coupling device generates output signals based on currents passing in the wire. The assembly also includes a system power reservoir connected to the magnetic coupling device and storing electrical energy therein based on power signals passing in the wire extending therethrough and generated by the magnetic coupling device. The assembly also includes a microprocessor which has internal common nonvolatile memory therein and which receives its operating power from the system power reservoir. The assembly also includes a decoder which is connected to the magnetic coupling device, which decodes communications signals passing in the wire extending therethrough and generated by the magnetic coupling device, and supplies those decoded communications signals to the microprocessor. In addition, the assembly includes a trigger circuit connected between the system power reservoir and a fuse head in the explosive detonator for supplying, under the control of the microprocessor, electrical energy from the system power reservoir sufficient to fire the detonator connected thereto.

In a preferred embodiment, the assembly further includes a wireless communications link connected to and controlled by the microprocessor. The communications link provides information regarding the current status of the operation of the microprocessor or data stored therein. For example, the wireless communications link can be an infrared light emitting diode. In addition, the communications signals passing through the wire and generated by the magnetic coupling device can include timing signals from an external programming device. The timing signals are stored in the nonvolatile memory of the microprocessor and form a detonation time delay for the electronic assembly. With the wireless communications link, the detonation time delay stored in the microprocessor can be supplied back to the programming device through the communications link to confirm the accuracy of the detonation time delay provided to the microprocessor.

The power signals generated by the magnetic coupling device can be supplied to a power rectifier which supplies its output power to the system power reservoir. In a preferred embodiment, the power rectifier is a full wave diode bridge rectifier. In addition, the system power reservoir can be a capacitor and the decoder can be a pulse discriminator. A preferred magnetic coupling device for the present invention is a toroidal transformer.

The assembly can further include a clock that supplies timing signals to the microprocessor and a power regulator that receives power from the system power reservoir and supplies regulated voltage to the microprocessor. A low voltage threshold can be provided to monitor the voltage on the system power reservoir and supply this voltage to the microprocessor, such that if the voltage on the system power reservoir drops below a predetermined value, the microprocessor will fire the trigger circuit and supply power to the fuse head, only after a valid fire message had been received.

The trigger circuit can include a pair of switches linked together in a way such that both switches must be activated by the microprocessor before power is supplied from the system power reservoir to the fuse head. In one embodiment, the trigger circuit can include four circuits that form a pair of switches, including a high side hard drive, a low side hard drive, a high side soft drive and a low side soft drive. In one embodiment of the assembly, the communications signals passing through the wire and generated by the magnetic coupling device include test signals for testing the functioning of the four drives in the trigger circuit. In this manner, if any drive has a fault therein, the assembly will not accidentally trigger the passage of power to the fuse head and cause an accidental explosion.

In a preferred embodiment, the communications signals passing through the wire and generated by the magnetic coupling device include timing signals which store in the nonvolatile memory of the microprocessor a specific detonation time delay and, thereafter, include control signals for activating the electronic assembly to fire, at the preprogrammed time delay, a detonator attached thereto.

We have also invented a method of programming a detonation time delay into the electronic delay assembly described above as well as a method of conducting a blasting operation using the electronic delay assembly discussed above and a detonator attached thereto.

DESCRIPTION OF THE PREFERRED EMBODIMENTS

Figure 1:
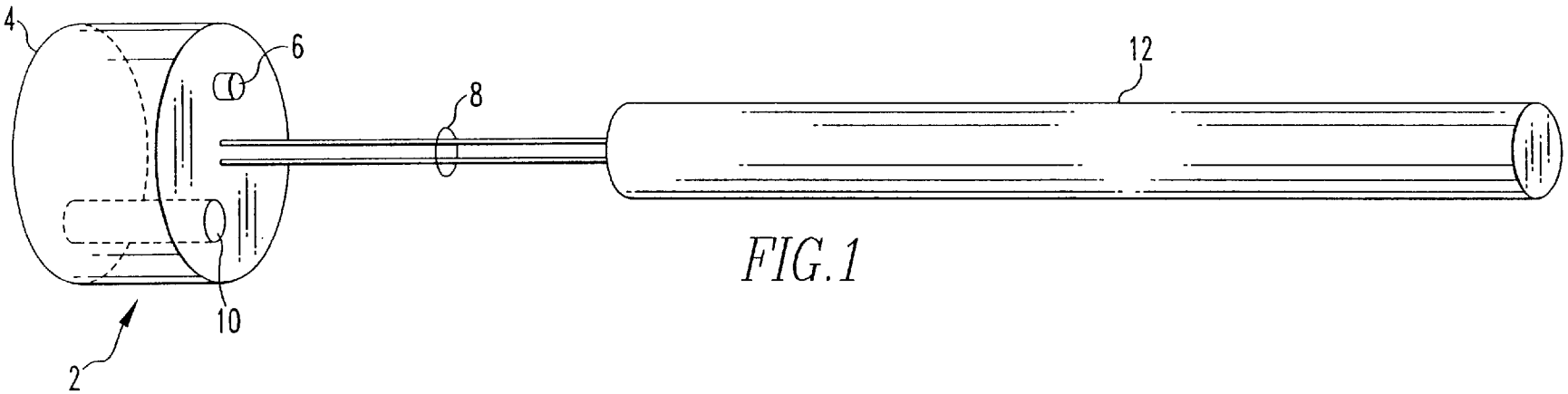
FIG. 1 is a perspective view of a programmable electronic delay detonator in accordance with the present invention.

A review of the overall system of the present invention will be discussed before referring to the drawings, which show the details of the various elements of a preferred embodiment of the system and its operation. The heart of the system is an element referred to as the programmable electronic delay detonator, also referred to as a detonator. This detonator is programmed by a handheld programmer which receives the detonator and programs the detonator with a desired time delay for detonation. An element on the detonator, preferably an infrared sender, communicates the programmed delay to the programmer and confirms that a particular detonator has actually been programmed with the desired delay. After the detonator is powered-up and before the time delay is programmed therein, certain tests are carried out in the integrity and operability of the device.

The programmed detonator is then installed into a borehole for a particular explosive charge. A plurality of similar detonators are programmed with a desired delay, specific for each particular borehole, and installed in place. All of the detonators are wired together to a blasting unit, also referred to as a blaster, which controls and conducts the final detonation of the various detonators and, thereby, the explosive charges in the boreholes. Since the number of detonators and length of wire vary in each situation, the blasting unit first determines the electrical characteristics of the detonators and wires connected to it and makes appropriate system adjustments accordingly. The blasting unit then sends a signal to power up all of the detonators. Certain tests on the integrity and operability of the various detonators are carried out. Control signals are then sent by the blasting unit to initiate the blast operation in the desired sequence.

An important feature in the detonator is that it is coupled to both the programmer and to the blaster through a magnetic coupling device, such as a toroidal transformer. This forms a current coupling, rather than a voltage coupling, to the detonator. In this manner, no lead wire must be pre-installed to the detonator. Instead, a wire is passed through a hole in the magnetic coupling device (transformer), and the programmed detonator is lowered into the borehole. In this manner, the length of wire needed to install the detonator is cut at the site for a particular depth/length of the borehole. Moreover, the detonator is programmed with desired delay at the site by the programmer. Therefore, each borehole can have a detonator installed therein with a desired time delay by merely carrying around a programming unit, a plurality of identical, unprogrammed detonators, and a spool of wire. The plurality of programmed and installed detonators are connected to the blasting unit by forming a wire loop at the surface by connecting the lead wires attached to each detonator into a loop.

One embodiment of a programmable electronic delay detonator 2 in accordance with the present invention is shown in FIG. 1. The device in FIG. 1 is proposed as a stand alone timing and detonation device. The electronic delay detonator 2 includes an electronic assembly 4 which has an electronic circuit board (not shown), an infrared light emitting diode (LED) 6, a pair of connection wires 8, and a round hole 10 intended for passing a wire therethrough. This group of components is potted in a cured compound in order to form a round cylindrical puck-shaped assembly 4. The pair of wires 8 are attached to an electric detonator or blasting cap 12, preferably with no delay within it (an instant electric detonator). The electronic assembly 4 constitutes an electronic delay and firing device, and the instant electric detonator or blasting cap 12 constitutes a charge initiation device. The entire detonation unit 2 will be used to accept a delay and initiate an explosive firing of an explosive charge.

When the electronic delay detonator 2 is implemented in the final installation, it will have a single conductor of wire passing through the center hole 10 in the electronic assembly 4. This one wire will carry sine wave currents that will provide both power and communications signals to the device. The detonator 2 may in some cases be connected to a programming device that will set and read delay time values. This programmer is described later. In another use, the wire may be powered from a blasting unit that will initiate firing procedures. This blasting unit will be described later.

During some detonator operations, it is necessary to receive a response from the electronic delay detonator 2. In this case, a message or signal will be transmitted from within the electronic assembly 4 via the infrared LED 6 that is a part of the unit. This signal will be received by an external device which will then indicate key parameters that have been sent from within the detonator 2.

The electronic delay detonator 2 has as a component the instant electronic detonator or blasting cap 12. This blasting cap 12, a small explosive charge, has no built-in chemical delay. It is incumbent upon the electronic assembly 4 to meter out the prescribed time delay, at which point the electronic assembly 4 will initiate the firing of the instant electric detonator 12. It is expected that the electric delay detonator 2 will explode within a very brief period of time.

Figure 2:
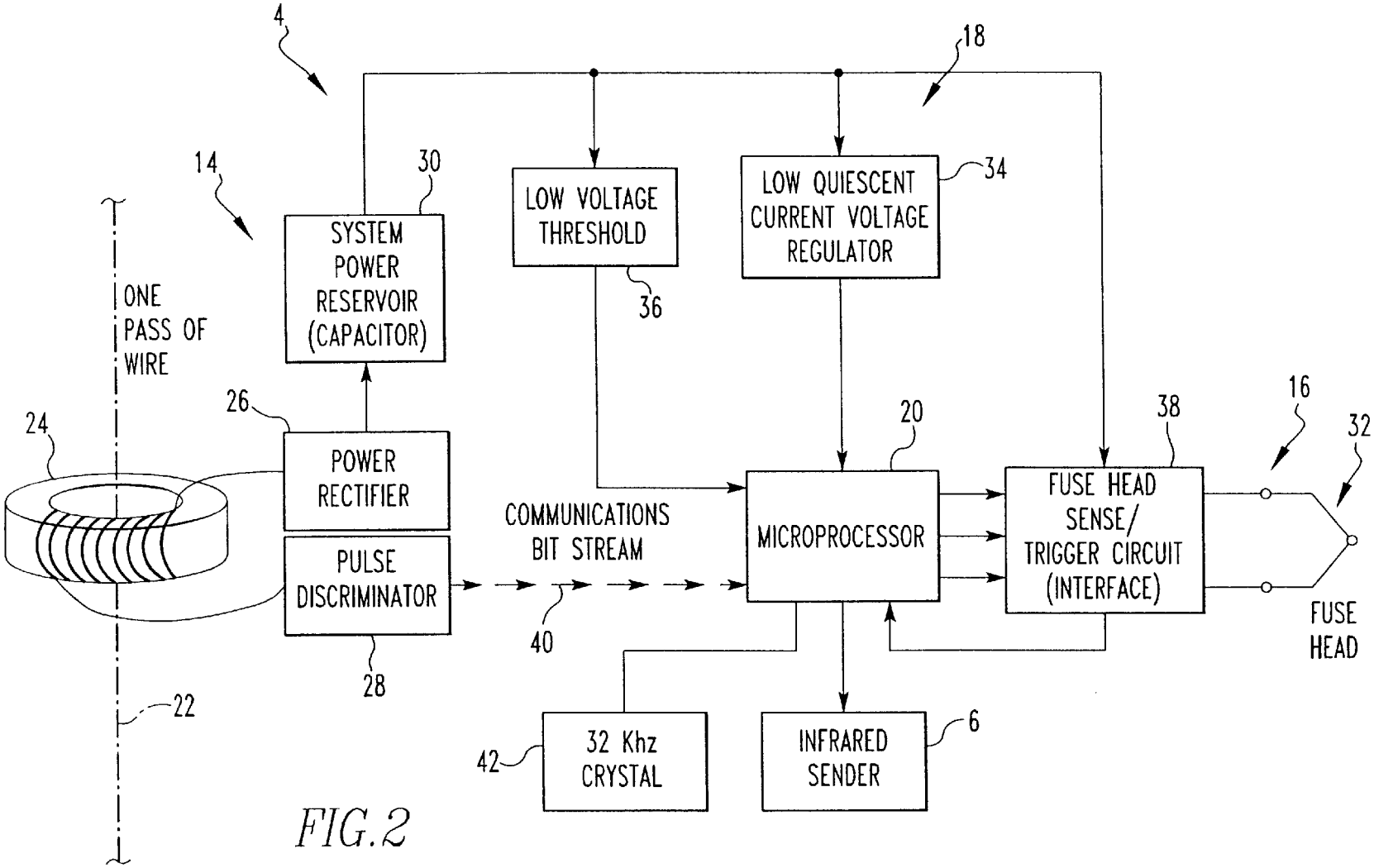
FIG. 2 is a block diagram of the electronics portion of the programmable electronic delay detonator shown in FIG. 1.

Referring to FIG. 2, a block diagram is shown of the electronic aspects of the electronic delay detonator 2 shown in FIG. 1. This device is comprised of a power section 14, a fuse head (electric detonator) circuit 16, a power regulation circuit 18, the infrared LED circuit 6, and a microprocessor 20. The single pass of wire 22 from an external device as described above is passed through the center of a magnetic coupler, such as a toroid with a number of turns on it, which together form a toroid transformer 24. The current that passes through the primary (the single pass through the primary) causes a current to flow in the secondary formed of the turns of wire. A power rectifier 26 then rectifies this signal into a rectified DC waveform. This rectified waveform forms the basis of the pulse discriminator 28. The current is then delivered to a system power reservoir 30, such as a capacitor, which holds enough voltage charge to power the microprocessor 20 and fire a fuse head 32. The voltage on the system power reservoir 30 may reach as high as 30 VDC. This voltage from the system power reservoir is then delivered to a low quiescent current voltage regulator 34, which provides a low voltage for the microprocessor 20 and other circuits. It is designed to draw relatively low current in order to extend the delay times that can be achieved from the system power reservoir 30. The reservoir voltage is also delivered to a low voltage threshold circuit 36, which allows the device to detect that the reservoir voltage is either above or below a fixed detection threshold. The reservoir voltage is also delivered to a fuse head circuit 38, which is specifically designed to perform two tasks: to test itself and the fuse head 32, and to fire the fuse head 32. Under control of the microprocessor 20, the fuse head circuit 38 detects the presence of any one defect within the circuit 38. In this way, the device can quickly determine if there is a hazardous situation due to a defect in materials or workmanship. If this set of tests is passed, and other appropriate trigger events occur, the fuse head circuit 38 is then capable of connecting the system power reservoir 30 directly to the external fuse head 32 in order to initiate a firing. The input circuit also incorporates a pulse discriminator 28 which detects the presence or absence of a main carrier frequency, and passes this conditioned pulse data through a communications bit stream 40 to the microprocessor 20. This is the channel by which messages can be delivered from the outside world into the microprocessor 20 within the device. There is also an infrared light emitting diode (LED) 6. This device, when pulsed with an appropriate stream of pulses by the microprocessor 20, will generate an infrared signal from within the device. This infrared signal can be detected from outside of the device, and the detonator 2 can therefore deliver status messages from within the detonator device to the outside world. This infrared LED 6 could also be performed through a similar RF or other wireless means. At the center of the device is a microprocessor 20 which incorporates a central processing unit, as well as program memory, data memory, flash memory, and input/output pins. The microprocessor 20 is programmed with a software program which, when interpreted by the central processing unit, causes the device to process messages and perform timing and detonation functions. The flash memory section is nonvolatile in nature, meaning that a loss of power (expected in the normal course of use) will not erase the saved data. This area is used to save data such as the current time delay, and possibly a serial number. A 32 KHz time base crystal oscillator 42 is connected to the microprocessor 20. This oscillator 42 allows the detonator 2 to have an accurate time base for delay time calculations, such that a number of such devices would produce relatively accurate time delays when used in unison.

Figure 3:
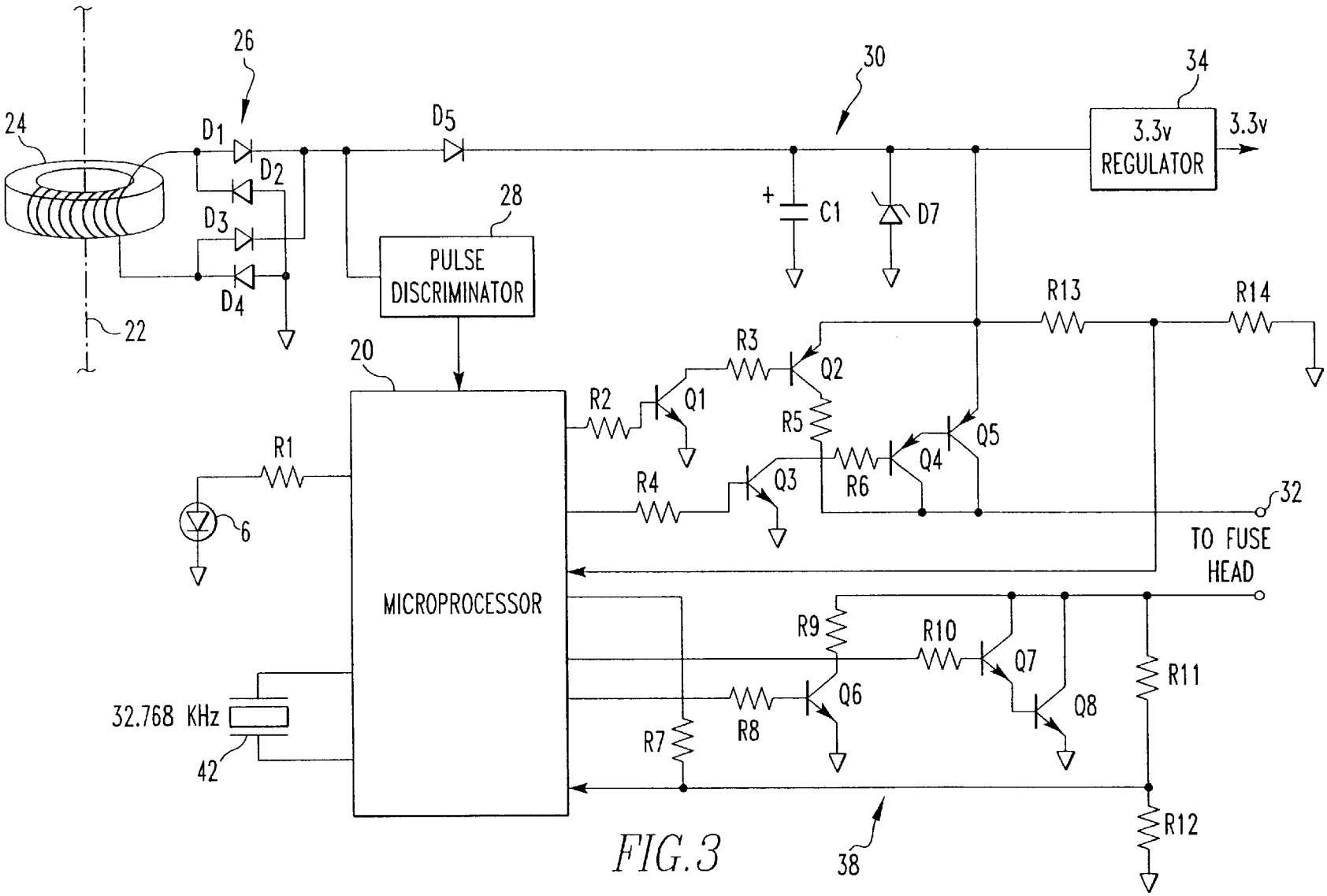
FIG. 3 is a circuit diagram of the electronics portion of the programmable electronic delay detonator shown in FIG. 1.

The detonator 2 includes the circuit as shown in FIG. 3. The device draws power and derives communications messages through the toroid transformer 24. This toroid 24 has a large number of turns of wire on a ferrite core. One pass of wire 22 carries the power and communications signals. A 5 KHz AC waveform is then rectified in the power rectifier 26, including four diodes D1 through D4 to create a full wave rectified version of the waveform. The pulse discriminator 28 detects the presence of the 5 KHz carrier to derive digital data supplied to the microprocessor. A fifth diode D5 further rectifies the current into the remainder of the circuit. In this manner, clean DC is available to the remainder of the system, and yet the 5 KHz carrier is supplied to the pulse discriminator 28. The current that flows through diode D5 is then collected in the system power reservoir 30, including capacitor C1. This capacitor C1 holds as much as a 30V charge. A TVS diode D7, included in the system power reservoir circuit 30, will clamp off the voltage at roughly 30 VDC, so that the capacitor C1 does not develop enough voltage to damage the circuit.

A low voltage threshold 36, formed by resistor networks R13 and R14 connected between capacitor C1 and ground, detects the voltage on the capacitor C1 and supplies that information to the microprocessor 20. If the voltage on the capacitor C1 drops below a certain level sufficient for firing the fuse head 32, such as 10 VDC, firing will take place at once provided a fire message had been previously received. A voltage regulator 34, which is connected to the capacitor C1, generates a lower 3.3 VDC signal to run the microprocessor 20. This voltage regulator 34 is selected to operate at a very low quiescent current and yet operate on voltage as high as 30 VDC. The 32.768 KHZ crystal 42 connected to the microprocessor 20 allows accurate timing signals to be generated within the microprocessor. The infrared LED 6 is connected to the microprocessor 20 through a series current limit resistor R1.

The microprocessor 20 allows the interpretation and generation of communications messages, testing of the fuse head drive circuit 38, and accurate delay times to detonator firing. It was specifically chosen to operate at low currents and high accuracy, and also has the capacity for nonvolatile storage within.

The fuse head circuit 38 is connected between the system power reservoir 30, the capacitor C1, and the fuse head 32 and functions, under the control of the microprocessor 20, as a switch to supply the necessary power to fire the fuse head 32, in order to ensure a safe operation, and minimize or eliminate accidental firing due to defects in the circuit. As shown in FIG. 3, the fuse head circuit 38 includes (a) a high side hard drive circuit, including transistors Q5 and Q4, acting as a Darlington pair, and resistors R4 and R6 and transistor Q3 functioning as a level shift circuit; (b) a high side soft drive circuit, including transistor Q2 and resistor R5, and resistors R2 and R3 and transistor Q1 functioning as a level shift circuit; (c) a low side hard drive circuit including transistors Q7 and Q8, acting as a Darlington pair, and resistor R10 functioning as a logic interface; and (d) a low side soft drive circuit, including transistor Q6 and resistor R9, and resistor R8 functioning as a logic interface. Resistor R7 is a bias resistor in a test section. A resistor divider formed of resistors R11 and R12 is attached to one leg of the fuse head 32.

Figure 4:
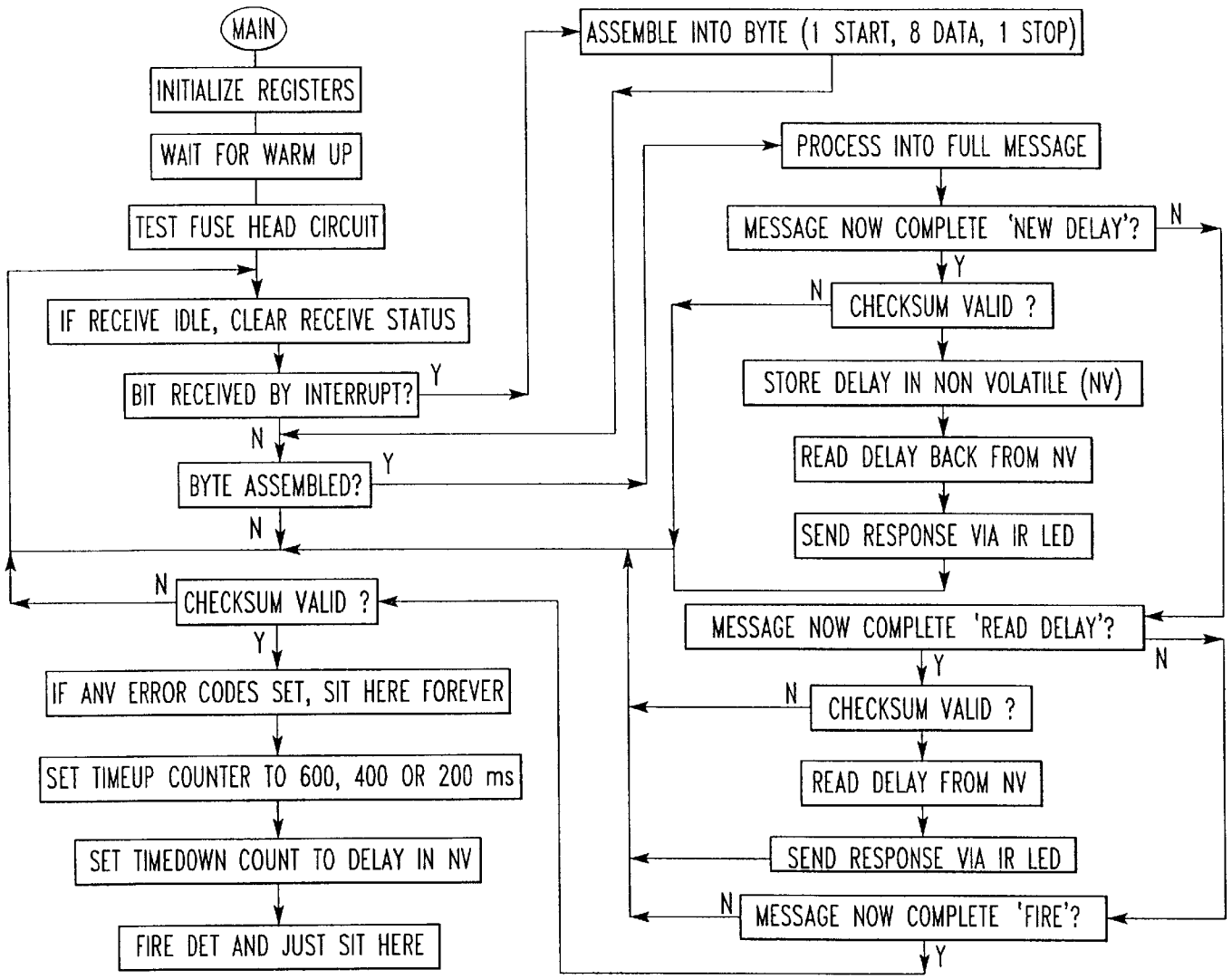
FIG. 4 is a flow chart of the software in the electronic delay detonator.

The main flow of software execution within the electronic delay detonator 2 is shown in FIG. 4. The detonator powers up as soon as loop current generates voltage on the capacitor C1, and thus provides adequate voltage to the regulator 34. A counter counts the number of preamble '0' pulses that arrive at a data pin of the microprocessor 20. Only after a given number passes, will the program proceed. This is in an effort to allow voltages to build up and settle down on the capacitor C1 before testing of the fuse head 32 begins.

Figure 5:
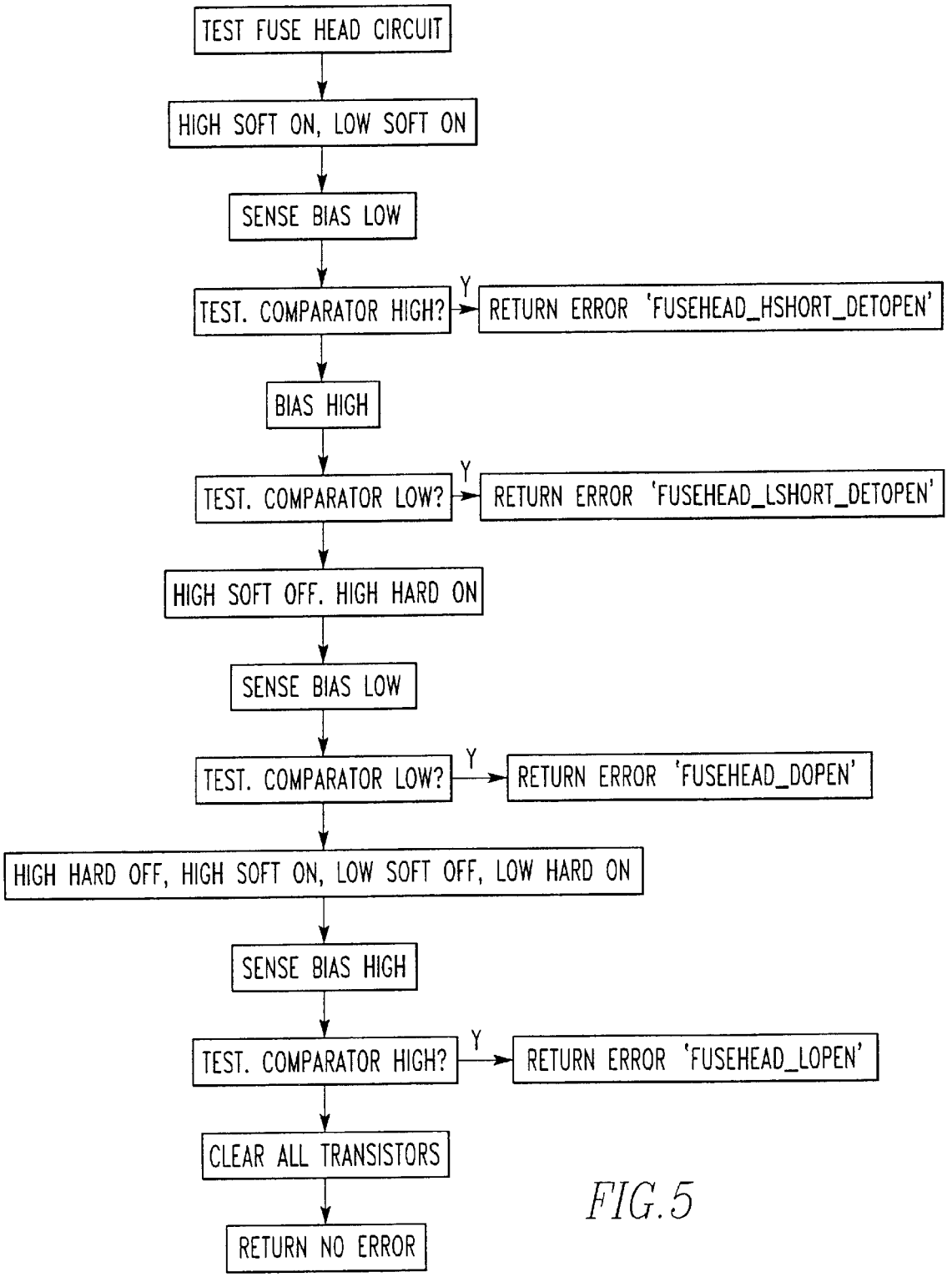
FIG. 5 is an additional flow chart of the software in the electronic delay detonator software program.

The fuse head circuit 38 is tested through software once at start-up. The software is shown separately as a block diagram in FIG. 5. As discussed above, there are four sets of transistors in the detonator circuit. One is a high side hard drive, one is a low side hard drive, one is a high side soft drive, and the last is a low side soft drive. One of the legs going to the fuse head 32 has a resistor divider (R11 and R12) attached to it. The voltage on the capacitor C1 goes through a similar resistor divider (R13 and R14). These two resistor divider voltages then go into the microprocessor (20) where there is an analog comparator. If the fuse head 32 were driven to half of the capacitor C1 main voltage, then the resistors are chosen to allow equal voltages to be present at the comparator. To make testing possible, there is an additional resistor attached to the comparator input (on the pin from the fuse head divider) that allows the microprocessor 20 to apply 0 and 3.3V bias voltages. Thus, the test voltage can be biased up and down from this center point, allowing the microprocessor 20 to determine that the fuse head voltage is truly near the center of the voltage span. The completed algorithm then works as follows. The high side soft and low side soft drives are turned on. The bias resistor is driven low. The comparator is tested for low. If it is low, the error for high transistor shorted or fuse head open is set. Then the bias is set to high. The comparator is tested for high. If it is high, then the low transistor is shorted. Then the transistors are cleared. The high side hard drive is turned on. The low side soft is turned on. The bias resistor is set to low.

The comparator is tested for low. If it is low, then the error is set to high transistor open. Then the transistors are cleared. The high side soft drive is turned on. The low side hard drive is turned on. The bias resistor is set to high. The comparator is tested for high. If it is high, then the error is set to low transistor open. Once this set of tests is completed, the fuse head drive circuit 38 has been completely tested for any single point of failure. If the high side and the low side hard transistors are set, the detonator will go off.

The software for the electronic detonator assembly 4 is shown in FIG. 4 as a block diagram. The unit begins operating when sufficient power has been delivered to provide voltage to the regulator. The software begins by initializing internal registers. The unit then waits for approximately 500 msec, derived by counting the number of '0' pulses that arrive over the loop. This allows external voltages to build-up to a level adequate to perform testing of the fuse head circuit 38. The unit then performs the fuse head circuit test, as described above. The main execution loop then waits for received bits, and subsequent message formation and processing. When a bit is received, it is formed into a byte. A '1' bit must be received to indicate the start of a byte. When a byte is formed, the message system forms a complete message. When a complete message is formed, it is tested for validity, and an action is performed. If the message is a 'set new delay' command, the indicated delay time is placed in nonvolatile flash memory in the microprocessor, read back out for confidence, and repeated back to the handheld unit over an infrared (IR) link. The message incorporates the error data identified thus far, and a checksum for confidence. If the complete message constitutes a 'read current delay setting' message, then the value currently stored in nonvolatile memory is read out, and a message is sent back to the handheld using means described for the previous message. If a fire message is received, it can be a fire tag 1, 2, or 3. Whichever the case may be, a time-up phase is begun, such that all detonators on the system are synchronized together at the same time reference point. The unit then begins a timer based on the time that had already been stored in nonvolatile memory. When this time period expires, the detonator circuit is activated by turning on two separate transistors. Both of these transistors must activate to fire the unit. The fuse head 32 then ignites.

Figure 6A:
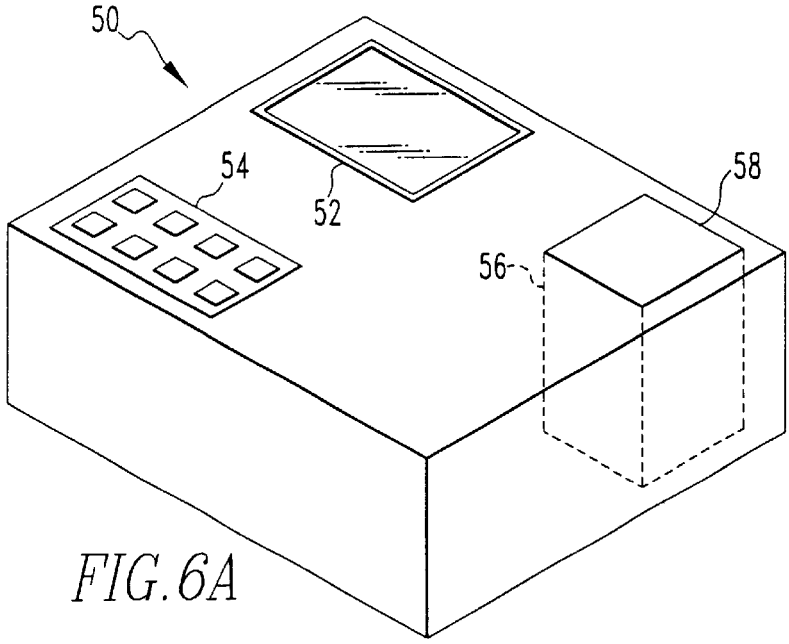
FIG. 6A is a perspective view of a handheld programmer in accordance with the present invention.
Figure 6B:
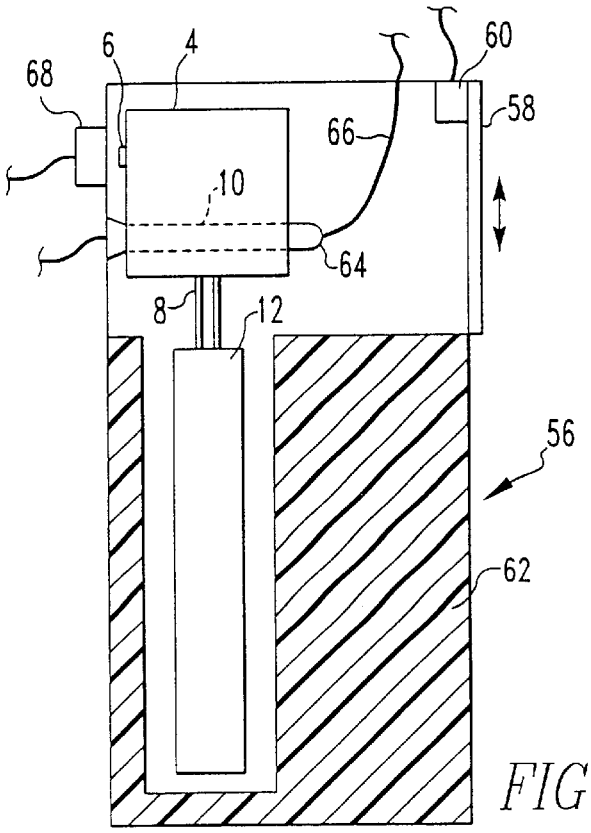
FIG. 6B is a schematic diagram of the protective chamber in the handheld programmer shown in FIG. 6A.

The handheld programmer is designed to allow a user to interact with a programmable electronic delay detonator 2 as previously described, with the goal of setting delays, reading delays, and performing serial number functions. One embodiment of a handheld programmer 50 is shown in FIG. 6A. The handheld device 50 has an LCD display 52 and keypad 54 on it to allow interaction with the user and display of information. A protective chamber 56 is provided within which the user can insert a single electronic delay detonator 2. The details of the protection chamber 56 and the insertion of a detonator 2 therein is shown in FIG. 6B. The protective chamber 56 protects the user in the event that a detonator 2 is fired inadvertently. A protective cover 58 is provided on the handheld device 50 and allows the complete covering of the detonator 2 within the protective chamber 56. A cover switch 60 verifies that the user has closed the protective cover 58 before any power or communication signals are applied to the detonator 2. The hole 10 in the electronic assembly portion 4 of the detonator 2 is placed over a conductive pin 64 and a loop circuit is completed by attaching wire 66 thereto. Foam padding 62, or the like, can be provided in the protective chamber 56, at least around the explosive portion 12 of the detonator, for further protection. Once the detonator 2 is properly inserted into the protective chamber 56, the user can initiate a detonator programming instruction. Power is applied through the current loop formed of pin 64 and wire 66, and a communications message is delivered over the same. The detonator 2 will perform various of the desired tasks, including the setting of a new delay, the reading of the current delay, or the reading of a serial number. In any of these cases, the goal is to receive a response from the detonator 2. The detonator 2 has an infrared LED 6 incorporated into it, which is directed to shine toward an infrared detector 68, which is installed in the handheld programmer 50. This infrared detector 68 will receive a message and deliver it to a microprocessor within the handheld programmer 50. The message is interpreted for a specific meaning or for needed data, and this information is then displayed on the display 52. Displayed messages may consist of indicating a defective fuse head circuit, a successful delay time programmed, a delay time that is currently in memory, or a serial number as implemented in this unit. Batteries within the handheld programmer allow the unit to be field portable.

Figure 7:
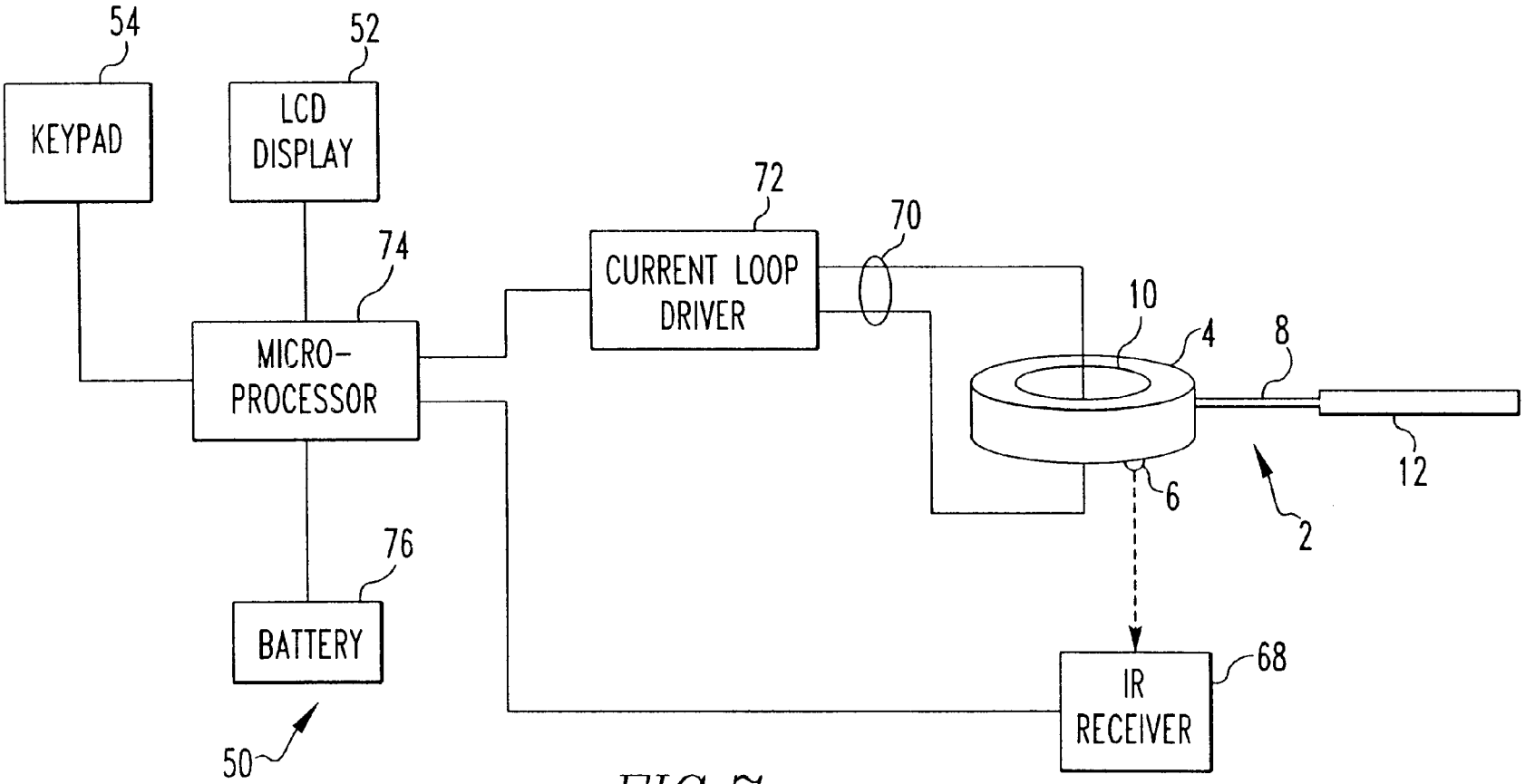
FIG. 7 is a block diagram of the electronics portion of the handheld programmer shown in FIG. 6A.

As shown in more detail in FIG. 7, when the user installs an electronic delay detonator 2 into the handheld programmer 50, it is coupled to the handheld programmer 50 through a single wire loop 70, formed by pin 64 and wire 66 in FIG. 6. Data coming back from the detonator 2 is transferred via an infrared LED 6 and received via an infrared sensor 68. The user can select from a number of pertinent commands or messages on the keypad 54 and LCD display 52. The unit will then generate a 4A RMS current in the loop of wire 70 that passes through the central hole 10 in the electronic assembly 4 of the detonator 2. The current is comprised of an audio range frequency, usually 5 KHz to 10 KHz. The current is further modulated on and off (On Off Keying or OOK) in a pattern which allows the transferal of ones and zeros. These ones and zeros form binary messages which when checked for authenticity, command the detonator 2 to perform certain tasks. A typical command that the handheld programmer 50 requests is to set the delay time to a specific value. There is also a message to request the currently set delay value without changing it. When the detonator 2 receives the message, and performs the requested task, it will generate and send a response over the infrared link. The handheld programmer 50 will capture this message, and if it has met all requirements for validity, will indicate a successful operation on the display 52.

The handheld programmer 50 is designed to allow the user to insert a detonator 2, set or read a delay time into or out of the detonator 2, and then install the detonator 2 into a borehole with an explosive charge. The handheld programmer 50 has a current loop driver circuit 72 that is similar to the one in the blasting unit, just designed to operate over a few inches of wire. The software program in the microprocessor 74 allows the user to enter a delay via the keypad 54 and request that the detonator 2 be programmed with this value, or the user can simply request that the detonator 2 be interrogated to determine the time already programmed into the detonator 2. In either case, the program will start up the current loop driver 72 for one second to power the detonator 2. After the power up, the message is sent over the loop 70 to the detonator 2. The detonator 2 processes the message, and then a response is sent back to the handheld 50 into the infrared receiver 68. This message is processed by the handheld 50, and the results displayed on the LCD display 52. The handheld device 50 is preferably powered by a battery 76.

Figure 8:
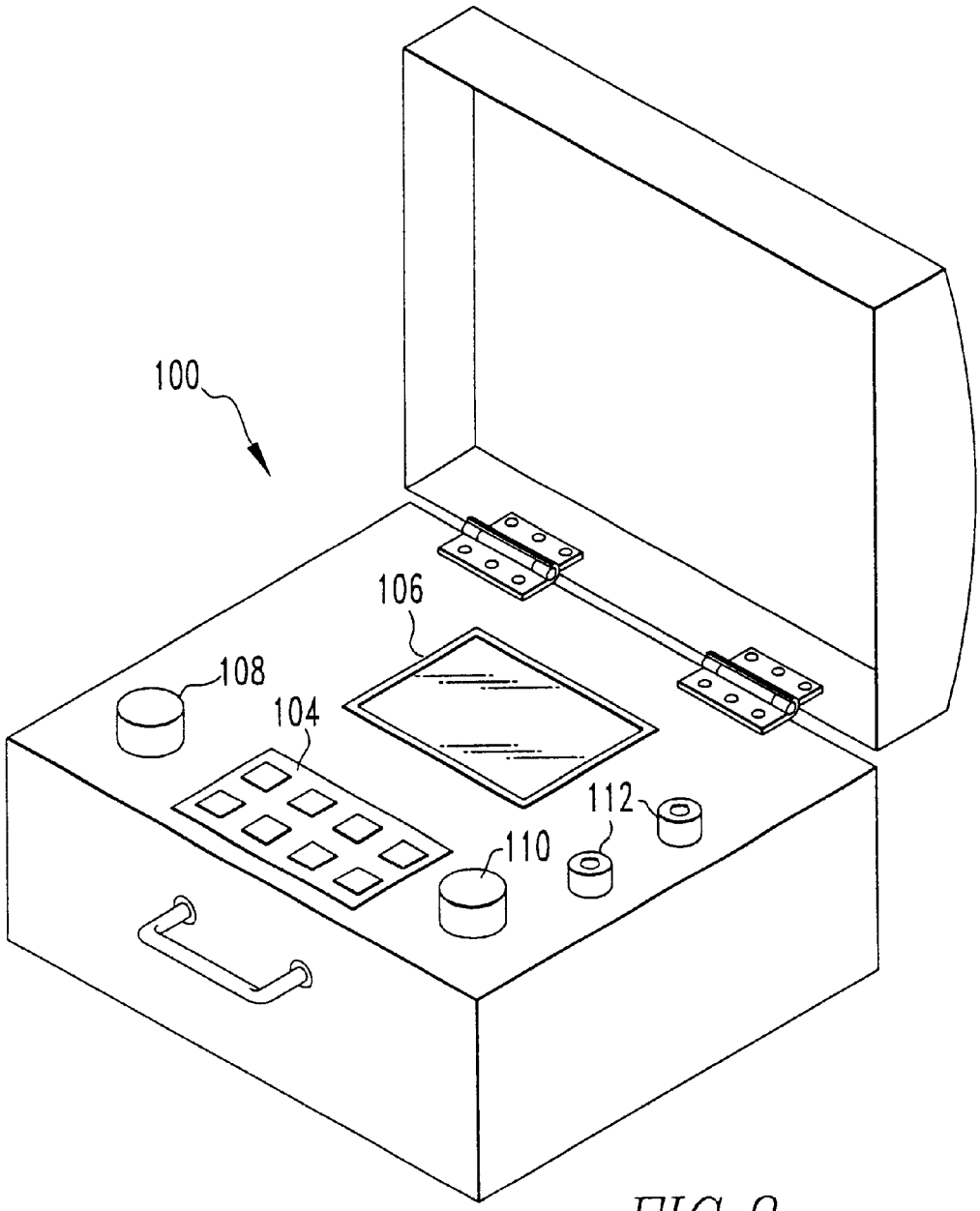
FIG. 8 is a perspective view of an electronic blasting unit in accordance with the present invention.
Figure 12:
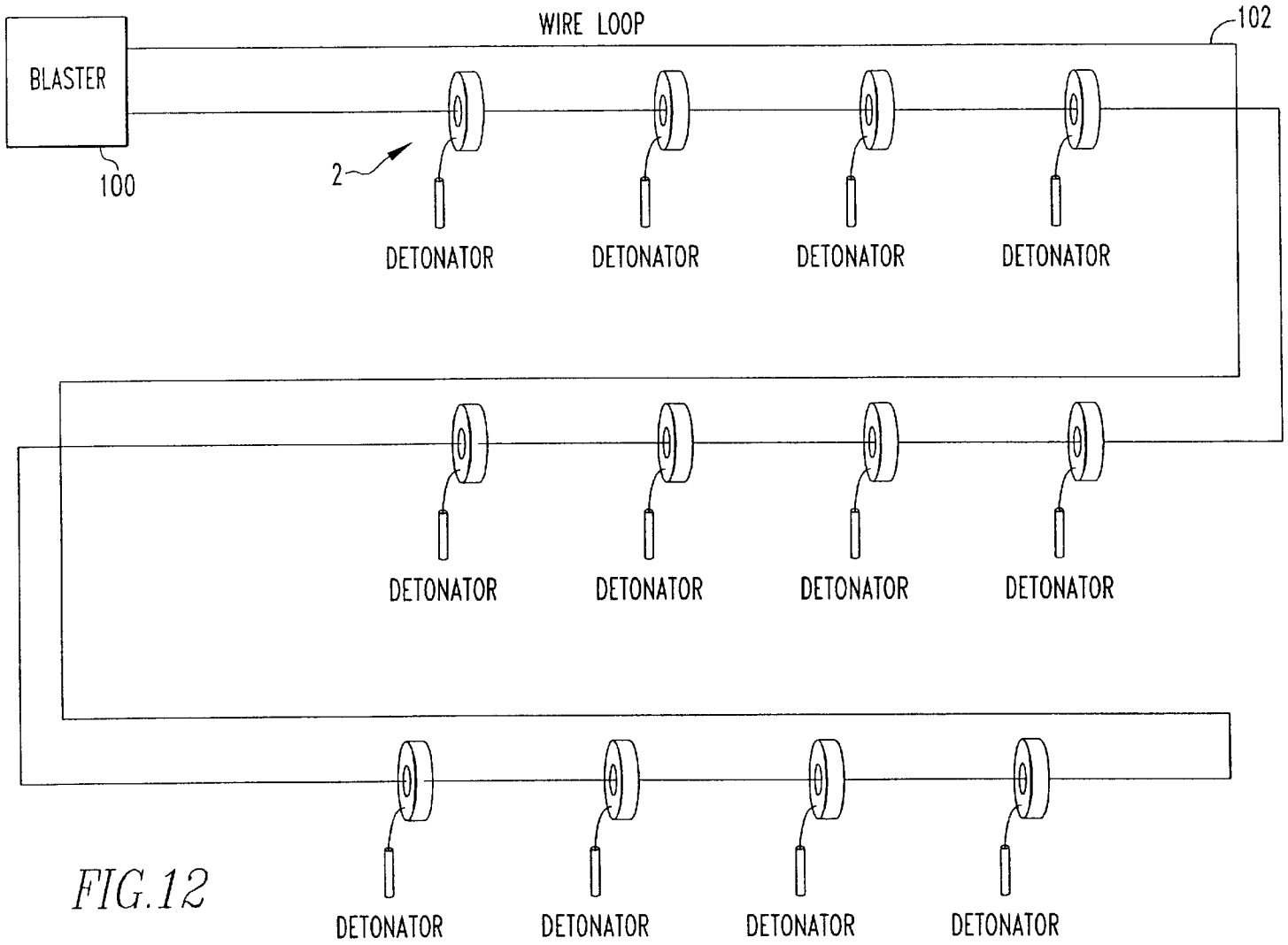
FIG. 12 is a diagram of a system wired in the field with a blasting unit and a number of programmable electronic delay detonators in accordance with the present invention.

The blaster or blasting unit 100 as shown in FIG. 8 is a portable device that allows the operator to present electrical power and electronic communications signals to a loop of wire. As shown in FIG. 12, the blaster 100 is connected to a loop of wire 102 that has a number of electronic delay detonators 2 installed on it, as previously described. The blaster 100 is designed to perform a number of key tasks. It will measure the impedance of the loop of wire 102, and adjust its output voltage to achieve a specific desired current value. The blaster 100 will then apply a sinusoidal waveform for a period of perhaps one second to allow all detonators 2 installed on the system to accumulate a voltage charge sufficient to power each device. The blaster 100 will then, on user command, issue a computer-generated communications message that will initiate a time sequence that ultimately results in the detonation of each detonator 2. This series of tasks is performed by the blaster 100, which is housed in a suitcase-sized case and powered by an internal battery, as described hereinafter in more detail. The blaster 100 has a keypad 104, LCD display 106, an "arm" button 108, a "fire" button 110, and posts 112 to connect the wire loop 102 to the blaster 100.

In order to accommodate the wide variety of impedances represented by both a variable length of wire 102 and a variable number of detonators 2 in the system, the blaster 100 has been designed to identify the impedance of the loop (wire 102 and detonators 2), and adjust to match it. This is done with a transformer with multiple taps. This transformer is identified as the line impedance matching transformer 114 in FIG. 9. The ultimate goal is to couple to the loop with a fixed target current level, usually 3 to 4 amperes peak-to-peak. Thus, the longer the length of the wire loop, the more power that is necessary to deliver this current level. The transformer 114 has a number of taps. The blaster 100, when enabled, will drive a test signal out onto the line and measure the current level using a current sense transformer 116. If it is not adequate to meet the target current, the tap of the transformer 114 is changed. This continues until the target for the electrical current is matched or exceeded. Using this method, a wide variety of line lengths and impedances are accommodated.

The blaster 100 is powered internally from a 12V lead acid gel cell battery 118. This power source was selected such that a backup power source could easily be supplied by an automotive cable, i.e., a car or truck battery. The unit then converts this 12 VDC source through converter 120 to a high voltage source, adjustable under control of the microprocessor 122 from 50 to 200 VDC.

Figure 9:
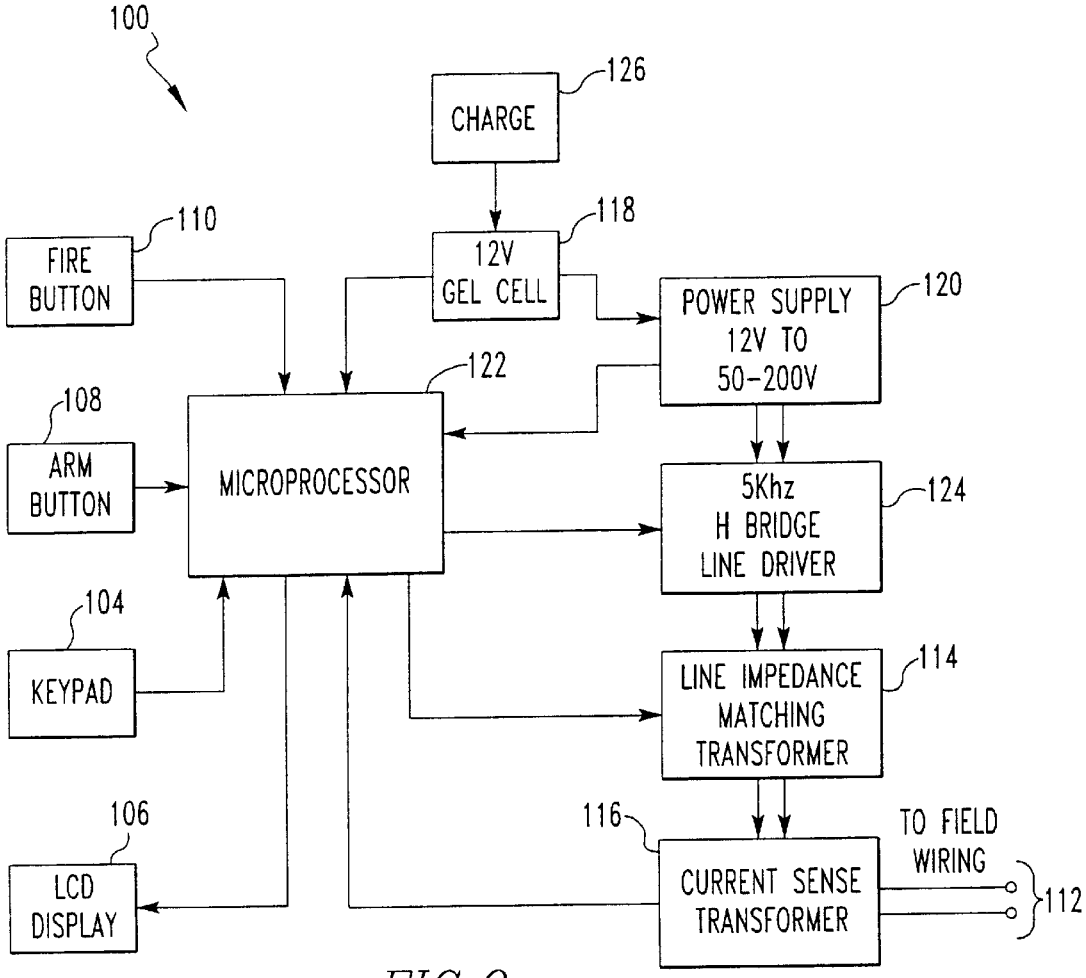
FIG. 9 is a block diagram of the electronics portion of the electronic blasting unit shown in FIG. 8.

The last major portion of the blaster is a line driver circuit 124. This circuit takes the high voltage and performs a switching operation using an H bridge circuit to create a square wave of 5 KHz. This high voltage square wave is then passed through the multiple tap transformer 114. Other features of the blaster 100, shown in FIG. 9, are the LCD display 106, a keypad 104, a battery charge circuit 126, and buttons 108, 110 for the user to initiate the operation. An alternate version for Europe will implement a key disable (not shown).

Figure 10:
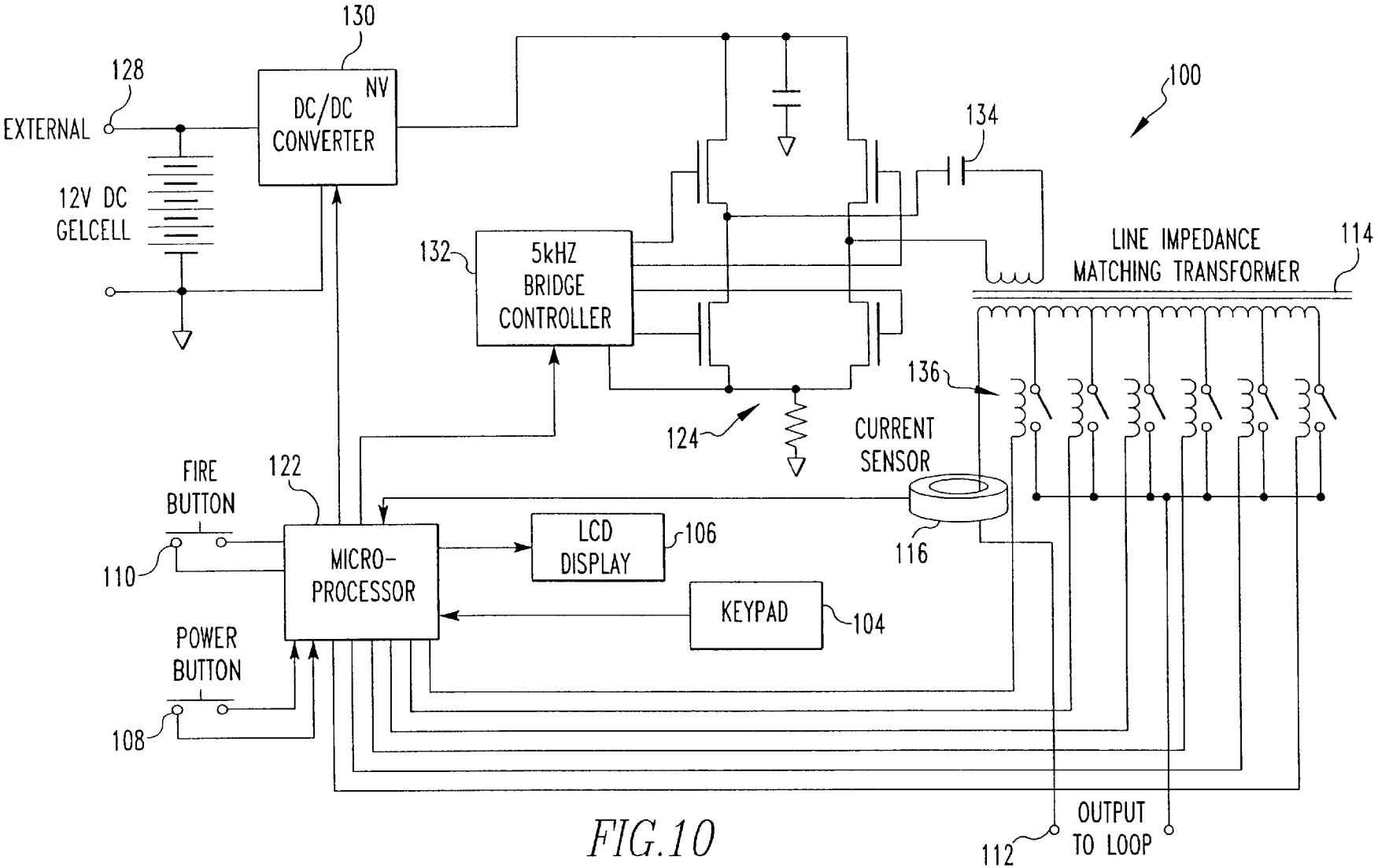
FIG. 10 is a schematic diagram of the electronics portion of the electronic blasting unit shown in FIG. 8.

The blasting unit 100 is designed to deliver energy by means of a current signal to a loop of wire, and encode communications signals on this current signal in order to deliver fire messages to the target detonators. The blasting unit 100 is programmed to send only fire messages. The unit does not have the programming to allow it to modify delay times or read them back. These communications messages are discussed hereinafter in greater detail. Referring to FIG. 10, the unit has a 12V gel cell battery 118 that provides power to the unit 100. There is an option to provide power from an external source through taps 128. The 12 VDC goes into a DC/DC converter circuit 130 that provides a microprocessor 122 controlled voltage to the line driver circuit 124. This converter 130 is capable of delivering 50 VDC to 200 VDC and as much as 600W of power to the remainder of the unit. The line driver circuit 124 is a bridge circuit, controlled by a switch mode circuit 132. It generates a 5 KHz square wave at the center taps. A capacitor 134 feeds the primary of transformer 114. This capacitor 134 prevents the primary of the transformer 114 from saturating. The transformer 114 provides multiple taps on the output to allow a correct match to the impedance of the loop of wire in the field. The secondaries are connected through a bank of relays 136 that allow the selection of one of the secondaries for connection the outside loop via taps 112. There is a current sensor 116 that allows the microprocessor 122 to carefully select the correct secondary tap on the transformer 114. The unit has a power arm button 108 and a fire button 110. The unit 100 also has an LCD display 106 and a keypad 104 to allow the user to make desired settings.

Figure 11:
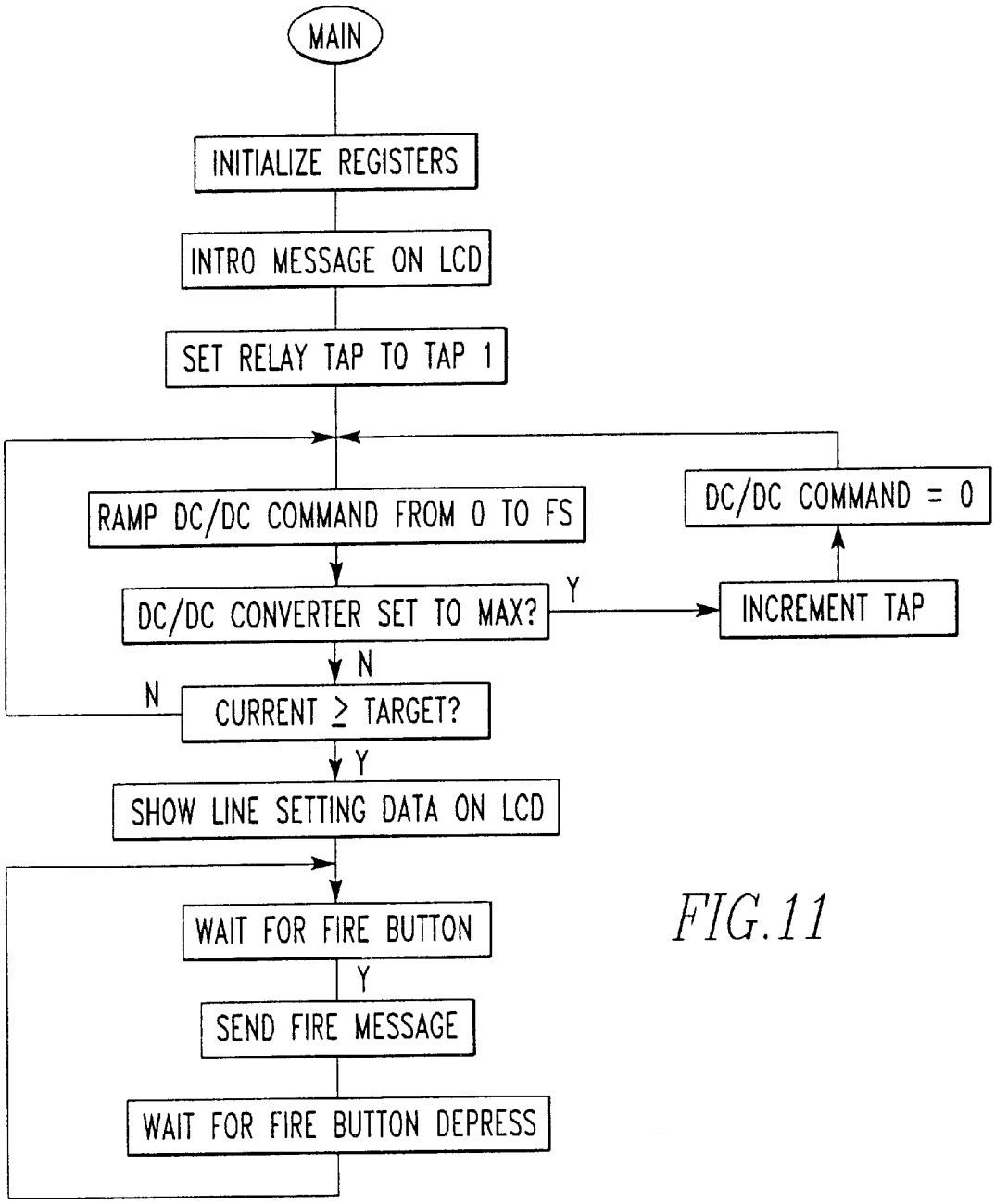
FIG. 11 is a flow chart of the software in the electronic blasting unit.

The blasting unit 100 has a microprocessor 122 that is programmed to operate the unit. Upon pressing the power button 108 the unit begins an initiation sequence. A flowchart is shown in FIG. 11. An introduction message is shown on the LCD display 106. The line transformer 114 is set to tap 1, and the DC/DC converter 130 is set to its lowest voltage. The program then increments the voltage command to the DC/DC converter 130, and monitors through sense transformer 116 the current flowing in the output pair 112. If the current level reaches a minimum setting, typically set to 3 to 4 amperes, the unit stops changing the voltage. If the command to the DC/DC converter 130 reaches a maximum, and the current has still not arrived at the minimum value, then the program will set the unit to the next tap on the transformer 114. Starting the DC/DC command at the lowest setting again, the program then repeats the ramp process with the intention of reaching the current setpoint.

Once the program reaches the target output current, the unit updates the LCD display 106 with the current data. The unit will present this full power waveform to the output loop for a full second, such that every detonator 2 on the line has a chance to accumulate a full charge. The LCD display 106 is updated once again, indicating to the user that the fire button 110 may be pressed. The fire button 110 can now be pressed, and when it is, the fire message is encoded onto the current loop. This fire message will trigger the detonators, and the user can now release the buttons.

The primary distinction that separates this design of this detonator system from all existing approaches is the implementation of a current loop, as opposed to a voltage pair, to transfer power and communications. Please refer to FIG. 12. This method allows the use of a transformer 24 (with the hole 10 in the center of the electronic assembly 4) to couple current to each and every detonator 2. Also, where a voltage pair will be susceptible to voltage drops and interference, the current loop will deliver an equal amount of charge energy to every detonator on the system, as well as being extremely impervious to interference from outside influences. This transformer coupled solution is susceptible primarily to magnetic coupling, which is a form of electromagnetic interference which is much harder to develop. The area inside of the loop in this system is also minimized, returning along the same path, and is thus even harder to influence. Additionally, the value of current and frequency employed in the system is such that it would take a truly massive interference source to impact the reliability and safety of the system. This method of connecting the detonators allows the blaster 100 to use plain insulated wire, making point-to-point connections in the loop on the surface. This surface connection does not use a connector of any sort, and allows the installer to go back and reconnect or reconfigure the network at will.

In addition to the novel topology of the wire loop, a unique communications method is employed. The current waveforms presented to the loop are broken into packets. The frequency of the arrival of these packets is the same, but the duty cycle is changed. This duty cycle adjustment on a bit-by-bit basis allows the encoding of binary messages within the power being delivered at the same time. Messages are formed from the individual bits, and a number of separate commands can be established and delivered to the detonators.

A second communications method exists within the system. Each electronic delay detonator 2 has within it an infrared LED 6, as described above. When used with the handheld programmer 50, described above, status and information messages can be sent back from the detonator 2 to the handheld programmer 50.

The system of detonators 2 and a blaster 100 are interconnected with a novel method. This method incorporates a long loop of wire, where each detonator is connected into the loop with the wire passing once through the center of the detonator 2. The loop of wire that passes through the detonators on a typical project can be any length from 100 meters (test modes only) to 5000 meters of wire. The wire is laid out in a pattern that resembles a pair in some ways, but is really a loop (FIG. 12). There is no end termination so to speak. The wire 102 leaves the blaster 100, travels over land, down the first hole, through the detonator once, back up the hole, and on to the next detonator. This continues on until all detonators have been threaded with the wire once, and then the wire is returned to the second terminal 112 on the blaster 100. It may be of some advantage to return this wire along the same path as it traveled out in the first place. The goal is not to resemble a twisted pair, but instead to minimize the area inside of the loop, and thus reduce the coupling of the loop to the earth in a magnetic mode. This same return path is not essential, though. Since the wire run is in the form of a loop, with no termination resistance to speak of, it is susceptible to standing waves. Fortunately, at the audio frequencies that the unit operates, these standing waves are not significant, and have been overcome by using slightly more current.

A similar current loop system is utilized between a handheld programmer and a single electronic delay detonator. As shown above in connection with the handheld programmer 50, the detonator 2 is installed within a safety chamber. Referring to FIG. 6, a single conductor is passed through the center of the detonator 2, which is then powered by the handheld programmer 50 with the same current waveforms as are present in a fully installed field application.

The system of detonators is wired together with a single current loop of wire. Referring to FIG. 12, the final field installation is comprised of a blasting unit 100 and a number of individual detonators 2. The wire 102 is laid out in a loop that goes from the blaster 100, through the respective detonators 2, and back to the blaster 100. Electrical contact is not established between the loop 102 and the detonators 2, only a magnetic coupling.

Figure 13:
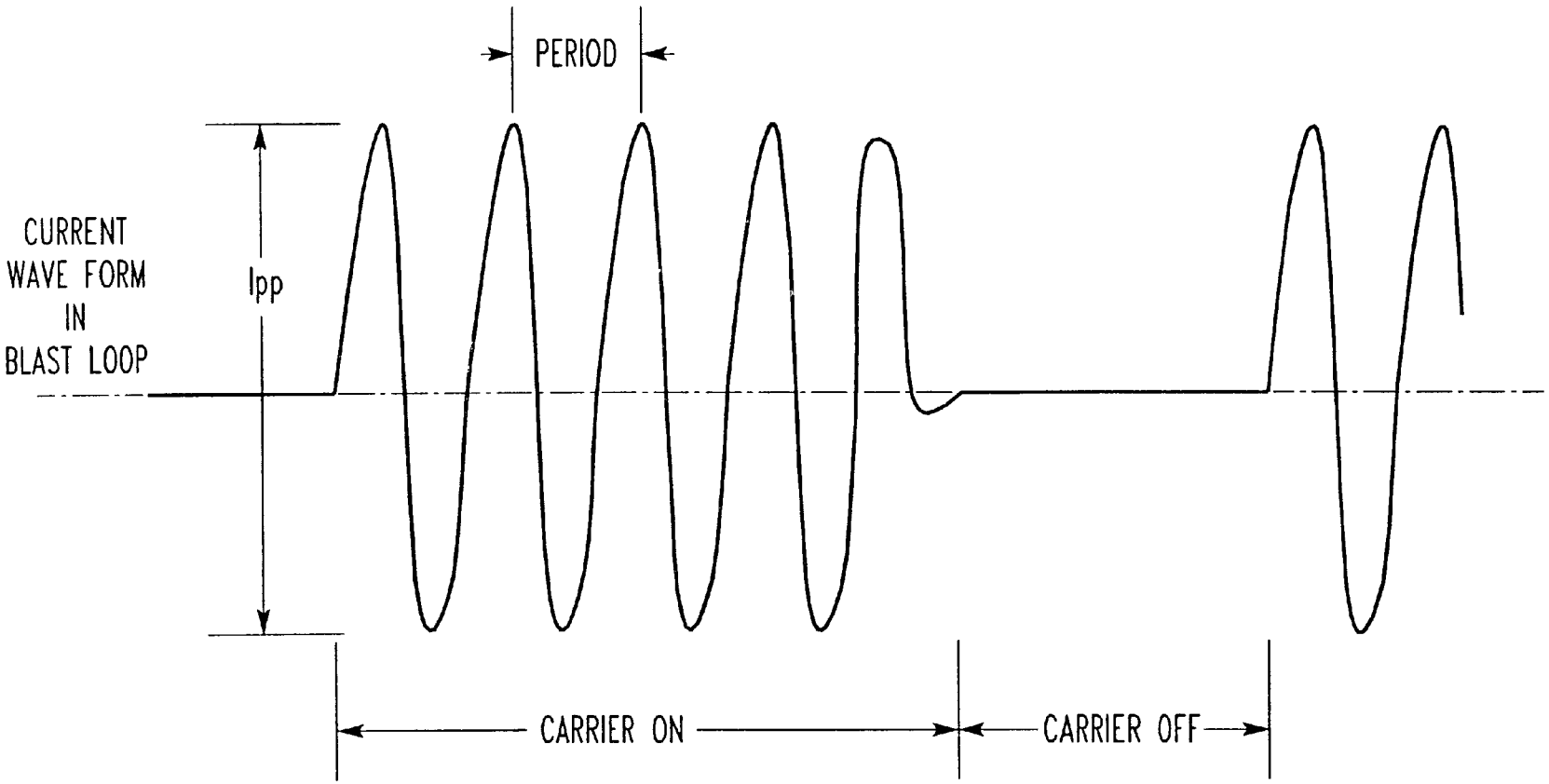
FIG. 13 is a diagram of the current waveform within the blasting loop.

Referring to FIG. 13, the current on the loop is comprised of a waveform of typically 5 KHz. The current is established with a sinusoidal waveform with a value of between 3 and 5A peak to peak, depending on the length of loop and number of detonators. As shown in FIG. 13, the waveform is turned on and off in order to convey a message. This is commonly referred to as On Off Keying or OOK.

Figure 14:
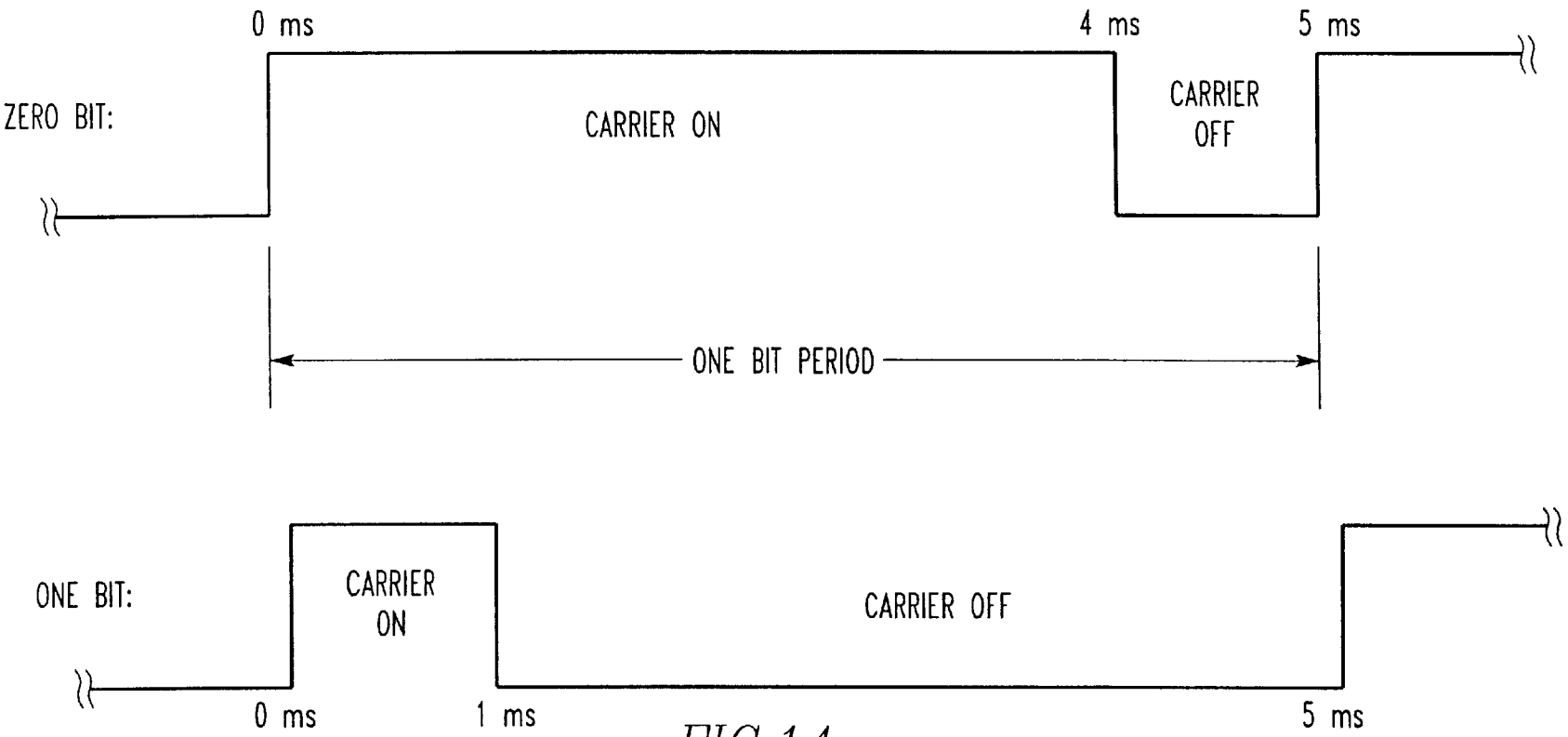
FIG. 14 is a diagram of the two waveforms that represent a binary 0 and a binary 1 on the blasting loop (carrier timing)

Referring to FIG. 14, the on and off patterns of the carrier are timed to form binary bits. The period between the start of the carrier is always 5 msec, and thus the bit data rate is 200 bps. Whenever the carrier is on for 4 msec and off for 1 msec, the bit is considered to be a zero. Whenever the carrier is on for 1 msec and off for 4 msec, the bit is considered to be a one. These two timing relationships are the only ones permitted on the current loop.

Figure 15:
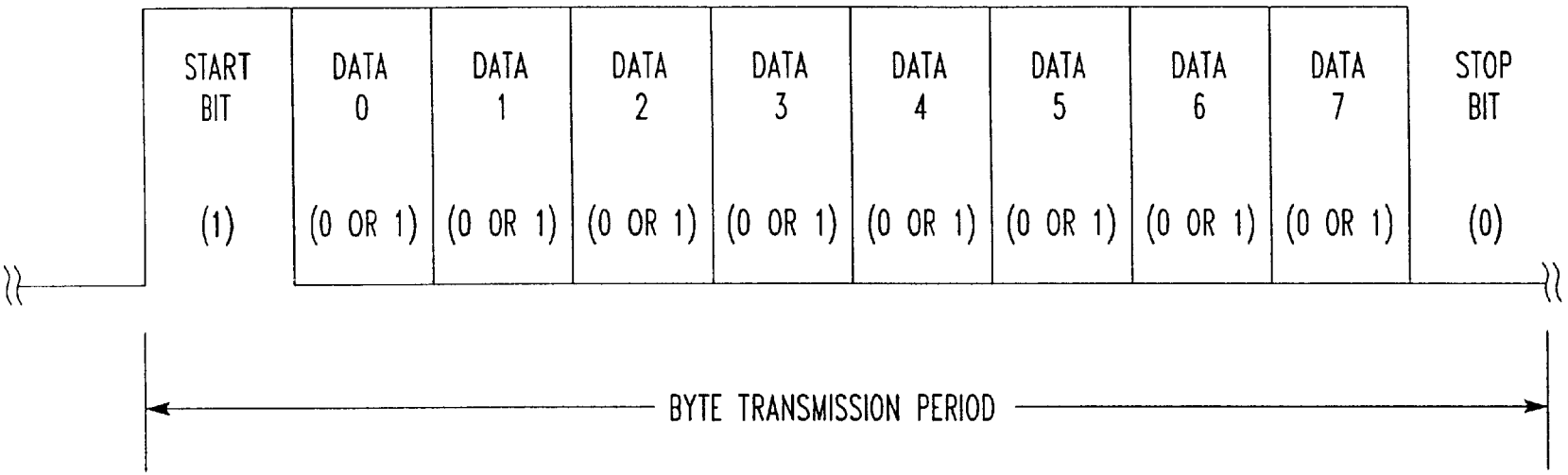
FIG. 15 is a diagram of the formation of an asynchronous byte.

The stream of zeros and ones are used to carry messages to the detonator(s). Referring to FIG. 15, the ones and zeros are now formed into a standard asynchronous word, with a single start bit (1), eight data bits, and a stop bit (0). Messages are then formed with these eight bit bytes.

Figure 16:
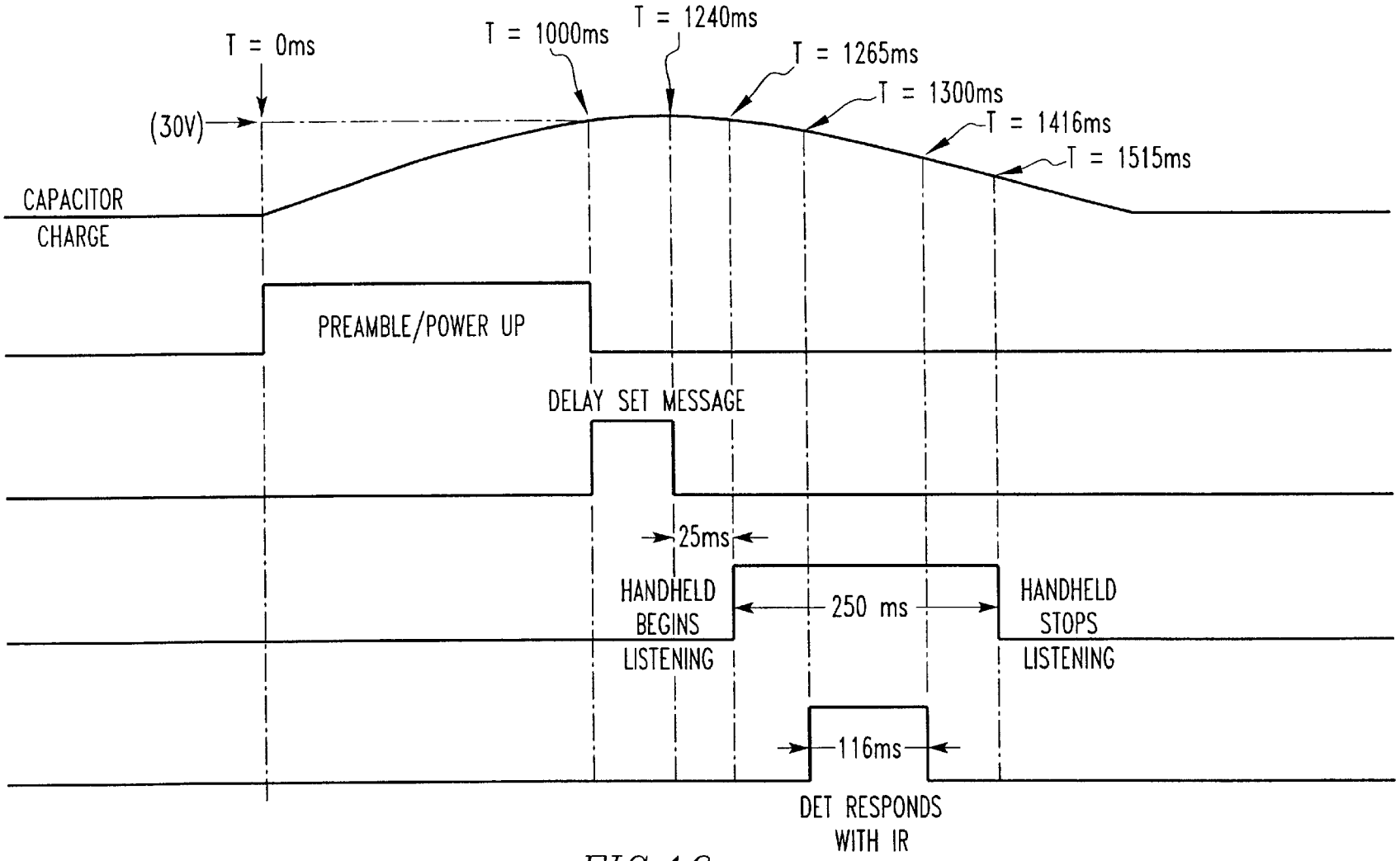
FIG. 16 is the waveform plots of a typical message time sequence.

The messaging scheme consists of the powering of the loop and the detonators, followed by the transmission of a message, and for two of the three messages, the reply via infrared with a message from the detonator. The detonator derives power from the loop for a full second before any message reception is expected. The unit gradually builds up a charge on a capacitor during this one second, until 25 to 29 VDC are present on the capacitor. Referring to FIG. 16, the power charge cycle is shown between times t=0 msec and t=1000 msec. The detonator will respond to two of the messages, namely set delay and read delay, with an infrared transmission. This infrared signal consists of groups of 38 KHz to 40 KHz On/off cycles of the Infrared LED in the detonator. These IR bursts last for about 260 msec. Each burst is detected by an IR receiver within the handheld, and converted to a pulse stream. Each burst becomes a 400 to 500 msec pulse. The pulses are spaced apart at 2500 msec, or 400 bits per second. The detonator spaces these bursts in such a way so as to generate a start bit, eight data bits, and a stop bit. These asynchronous words are then used to convey a message.

The infrared message is sent from the detonator to the handheld. It consists of five bytes. hex FF, delay hi, delay low, error byte, and checksum. The hex FF is sent to assist the handheld programmer in locking on to the incoming bits accurately. The high and low delay bytes are abutted to form a 16 bit delay word. It is simply a repeat of the word that is stored in nonvolatile memory. It is scaled in increments of 1/32768 seconds. The error byte encodes a number of possible detonator failure indications. Bits 0, 1, and 2 encode four possible fuse head drive circuit fault conditions. Bit 4 indicates that the nonvolatile memory is full. The checksum confirms the validity of the message.

The user of the handheld programmer may elect to send a new delay time to the detonator on hand. This message consists of a new delay command ID byte, the delay hi byte, the delay low byte, and the checksum. This message stores the delay in 1/32768 second increments. The new delay is stored in nonvolatile memory and an infrared confirmation message is sent. The user of the handheld programmer may elect to send a read current delay time message to the detonator on hand. This message consists of a read delay command ID byte and a checksum. The delay that is stored in nonvolatile memory is read out and an infrared confirmation message is sent.

The fire message is only sent by the blasting unit. It consists of three fire messages, which allows each and every detonator three chances to receive a valid fire message and initiate timing operations. The sequence of bytes is Fire command ID byte, Fire tag 1, checksum, fire command ID byte, Fire tag 2, checksum, Fire command ID byte, Fire tag 3, checksum. If a detonator receives a valid tag 1 message, it will set a count-up timer for 600 msec. If it misses tag 1 and receives tag 2, it sets a time-up counter for 400 msec. If it misses tags 1 and 2, and receives tag 3, it will set a count-up time for 200 msec. Regardless of which message is received, the count-up timer on all detonators arrive at the same time T=0 time together. Count down and detonate times are executed from this common reference point.

The present invention, as described hereinabove, includes a combination of key features which form a system of components that are used to program, install, and detonate a complete system. In the preferred embodiment of this system, three components are included: 1) a programmable electronic delay detonator multiples of which would be used for a single shot/blast operation; 2) a handheld programmer, which allows the user to set delay characteristics into each detonator before it is installed in the ground; and 3) a blasting unit which is used to power up and command a complete network of detonators to explode in the intended sequence and at the correct delay timings.

An important distinction that separates the design of the detonator system of the present invention from all prior art systems is the implementation of the current loop, as opposed to a voltage pair, to transfer both power and communications. The arrangement of the present invention allows the use of a transformer to couple current from either the blasting unit or the handheld device to each and every detonator. Whereas a voltage pair would be susceptible to voltage drops and interference, the current loop of the present invention will deliver an equal amount of charge energy to every detonator in the system. In addition, the current loop is extremely impervious to interference from outside influences. The design of the present invention is robust to the point of being able to withstand lightening strikes at a distance that is much closer than the relatively sensitive voltage coupled systems. In other words, the voltage system is hard coupled to each and every detonator, as well as the fuse head and, as such, any ground potentials which exist will produce a voltage difference between the individual detonators. This dangerous exposure to detonation does not exist with the transformer-coupled system of the present invention, as this system offers complete galvanic isolation at each and every detonator. In addition, the voltage coupled system would be susceptible to primary electrostatic interference, which includes lightening and radio signals. The transformer coupled solution of the present invention is susceptible primarily to magnetic coupling, which is a form of electromagnetic interference which is much harder to develop. The area inside of the loop in this system is also minimized, preferably returning along the same path, and is even harder to influence. Additionally, the magnitude of the current and frequency used in the present system is such that it would take a truly massive interference source to impact the reliability and safety of the system. The method of the present invention of connecting the detonators allows the blaster unit to use plain, insulated conductive wire, making point-to-point connectors in the loop on the surface. This surface connection does not use a particular connector of any sort, and allows the installer to go back and reconnect and reconfigure the network as desired.

A second advantage of the detonator system of the present invention is the incorporation of an infrared or other wireless feedback signal that is sent back by the detonator at the time of programming of the time delay. The transformer coupled loop requires relatively large driving signals to make a coupling of the signal and, as such, the detonator cannot respond back via the wire loop. Therefore, the detonator accepts any command messages, executes them and responds with the results of the operation over the infrared link. This simple check-back feature allows the programmer to be absolutely certain that the detonator is functional, healthy, has the proper delay, and is fully operational before that detonator is installed into the ground.

A further advantage of the present invention is the ability to accommodate a variety of lengths of wire between the electronics module and the actual detonable capsule. Whereas other hard wired systems may become susceptible to electrostatic discharge, the system of the present invention does not expose the circuit between the detonator itself and the electronics controlling the detonator to the remainder of the system wiring. Therefore, development of unsafe voltage potential is significantly more difficult. The distance between the electronics and the detonator head can be anywhere from one inch to ten feet.

A further advantage of the detonator is the manner in which the system is programmed with delayed times. There are two methods used to perform this. In a first embodiment, the handheld programmer is used to program a delay time into the detonator memory. When the blast or shot is performed, the blaster simply issues a global fire command to the loop and all detonators operate based on their time delays. In another alternative, each detonator is programmed at the site using a serial numbering system. Each detonator is preferably programmed with a unique serial number during manufacturing. This number can be modified over the loop with a message, but this would be done only at the factory. During field installation, each detonator would be scanned by a handheld device to retrieve the serial number of that detonator. The handheld device will organize these delays in a graphic display. When all of the detonators are installed, then the blaster reads all the serial number data from the handheld unit. Delay times would then be assigned to individual detonators and stored. When the loop is powered up during final blasting, the blaster unit will then send each detonator a delay which matches the respective serial number for a particular unit. In this type of a system, delay times can be adjusted after the detonators are installed in the ground, if such changes are necessary. In the preferred embodiment discussed above, the delay times are programmed into the detonator at the site by the handheld unit.

A further advantage of the present invention is the manner of verification of detonator electronic safety. Any electronic system must use some form of switch to energize the fuse head. If there was a failure of this switch element, then there exists the potential of a false trigger on initial power up. In the present invention, this initial power up would be at the time of programming, on the surface, of the delay time. This is not a desirable event, so a failure detection and avoidance system has been developed in the present invention. The electronic circuit that triggers the detonator is comprised of four main circuits: a high and a low circuit are present to allow the application of solid power, which has no inherent current limit. This pair of circuits is present for firing the detonation. A second pair of circuits and the soft switches are present with a resistor in series with each other in order to apply no fire test currents. On power up, the circuits are wired such that a failure of the microprocessor would render them all non-energized. Assuming the microprocessor does run, a test program applies a low side soft switch. If the high side hard switch is off, the detonator will pull to a low potential. If the high side switch side is on, indicating a shorted or defective circuit, then the detonator will not go to this low potential and a fault is detected. The test proceeds to the next phase, where the high soft circuit is turned on. The detonator should go to a high potential. If not, the low side hard switch is defective. At this point, it is assured that no shorted switches are present. Now, a high side hard switch and a low side soft switch are turned on. A no fire current should flow. If not, the high side hard switch is failed open. If this test passes, the low side hard switch and high side soft switch are energized, achieving the opposite test. If this test passes, all four circuits are considered to be present and operational. This arrangement will allow a single point of failure to occur and yet be detected without an accidental firing. Having satisfied this detonator test, the detonator is qualified as being completely safe and operational.

A further advantage of the system discussed above is the manner of protecting a detonator from receiving a fire message when it is being programmed with the handheld unit. Communications protocol allows for three messages including set delay, read delay, and fire detonation. Abort is accomplished by removing power and allowing the storage charge in the storage capacitor to decay. Non-fire voltage will be achieved in less than approximately ten seconds. Nevertheless, the simple method of protecting against a bad fire message is two fold. The handheld is not programmed with the data necessary for generating a fire message. In addition, the command message is comprised of sending a single byte for the command, as well as a checksum. Unless the bytes match and the checksum is correct, no action is taken. In order for a single byte to be misinterpreted as a different command, four bits must be improperly inverted. In addition, a one byte checksum is added to the end of the message and would have to be properly calculated to allow the message to be validated. The likelihood of the message meant to program the delay or read back the value could be interpreted as a fire message is very small.

Furthermore, there is a second facet of the message protocol which is included to ensure a robust system. It is imperative that a shot never goes off at the wrong time. By the same token, it is almost as important that a shot never be left without a firing message, since a borehole with live material in it after a shot is quite dangerous. This requirement is met with two design features. When a full shot system is fired up, all detonators must be synchronized and also begin timing down at the same time. In order that no shot be left out of the firing, the fire message is sent three times. Assuming all detonators have been given three chances to capture a valid fire signal, all of them are now precisely synchronized to the same reference time line. In addition, if a valid fire message has been received, and a time count is in progress, then the blasting unit will monitor voltage on the charge capacitor used to fire the detonator. If this voltage nears the no fire voltage before the final time has expired, then the unit will fire at that instant, before the charge is too low. Therefore, if there is a poor quality capacitor in the detonator, or if a shock wave has caused damage to the capacitor, then the shot will be performed early. This out of sequence behavior, which will be the exception to the rule, is considered to be more desirable than leaving live material in a hole after a shot.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An electronic delay assembly which can be connected to an explosive detonator having a fuse head therein and effect the firing of the detonator in a controlled manner, said electronic delay assembly comprising:

a) a magnetic coupling device having an opening therein configured to receive a conductive wire extending therethrough, with said magnetic coupling device generating output signals based on currents passing in the wire;

b) a system power reservoir connected to the magnetic coupling device and storing electrical energy therein based on power signals passing in the wire extending therethrough and generated by the magnetic coupling device;

c) a microprocessor which has internal, nonvolatile memory therein and which receives its operating power from the system power reservoir;

d) a decoder which is connected to the magnetic coupling device, decodes communications signals passing in the wire extending therethrough and generated by the magnetic coupling device, and supplies those decoded communications signals to the microprocessor; and e) a trigger circuit connected between the system power reservoir and the fuse head in the detonator for supplying, under the control of the microprocessor, electrical energy from the system power reservoir sufficient to fire a detonator connected thereto.

2. The electronic delay assembly of claim 1, further including a wireless communications link connected to and controlled by the microprocessor, with said wireless communications link providing information regarding the current status of the operation of the microprocessor or data stored therein.

3. The electronic delay assembly of claim 2, wherein the wireless communications link is an infrared light emitting diode.

4. The electronic delay assembly of claim 1, wherein the power signals generated by the magnetic coupling device are supplied to a power rectifier which supplies its output power to the system power reservoir.

5. The electronic delay assembly of claim 4, wherein the power rectifier is a full wave diode bridge rectifier.

6. The electronic delay assembly of claim 1, wherein the system power reservoir is a capacitor.

7. The electronic delay assembly of claim 1, wherein the decoder is a pulse discriminator.

8. The electronic delay assembly of claim 1, wherein the magnetic coupling device is a toroidal transformer.

9. The electronic delay assembly of claim 1, further includes a clock that supplies timing signals to the microprocessor.

10. The electronic delay assembly of claim 1, further including a power regulator that receives power from the system power reservoir and supplies regulated voltage to the microprocessor.

11. The electronic delay assembly of claim 1, further including a low voltage threshold which monitors the voltage on the system power reservoir and supplies this voltage to the microprocessor such that if the voltage on the system power reservoir drops below a predetermined value, the microprocessor will fire the trigger circuit and provide power to the fuse head, provided that a valid fire command had been previously received.

12. The electronic delay assembly of claim 1, wherein the trigger circuit includes a pair of switches linked together, such that both switches must be activated by the microprocessor before power is supplied from the system power reservoir to the fuse head.

13. The electronic delay assembly of claim 12, wherein the trigger circuit includes four circuits that form the power of switches, including a high side hard drive, a low side hard drive, a high side soft drive and a low side soft drive.

14. The electronic delay assembly of claim 13, wherein the communications signals passing through the wire and generated by the magnetic coupling device include test signals for testing the function of the four drives in the trigger circuit, in a manner that if any drive has a fault therein, the assembly will not accidentally trigger the passage of power to the fuse head and cause an accidental explosion.

15. The electronic delay assembly of claim 1, wherein the communications signals passing through the wire and generated by the magnetic coupling device include timing signals which store in the nonvolatile memory of the microprocessor a specific detonation time delay.

16. The electronic delay assembly of claim 1, wherein the communications signals passing through the wire and generated by the magnetic coupling device include control signals for activating the electronic assembly to fire, at a pre-programmed delay, a detonator attached thereto.

17. The electronic delay assembly of claim 2, wherein the communications signals passing through the wire and generated by the magnetic coupling device include timing signals from an external programming device, with the timing signals stored in the nonvolatile memory of the microprocessor forming a detonation time delay for the electronic assembly, and with the detonation time delay so stored in the microprocessor supplied back to the programming device through the communications link to confirm the accuracy of the detonation time delay stored in the microprocessor.

18. A method of programming a detonation time delay into the electronic delay assembly of claim 1, comprising the steps of:

a) placing the electronic delay assembly in a programming unit and passing a conductive wire through the opening in the magnetic coupling device;

b) passing a power signal through the wire which, in turn, causes electrical energy to be stored in the system power reservoir of the electronic delay assembly;

c) selecting the desired delay time for the electronic delay assembly;

d) passing a communications signals through the wire with the desired delay encoded therein which, in turn, causes the decoder to supply the desired delay time to the microprocessor;

e) storing the desired delay time in the nonvolatile memory of the microprocessor; and f) removing the programmed electronic delay assembly from the programming unit.

19. The method of claim 18, further including the steps of testing the operation of the trigger switch and discarding any electronic delay assembly which fails this testing.

20. A method of programming a detonation time delay into the electronic delay assembly of claim 2, comprising the steps of:

a) placing the electronic delay assembly in a programming unit and passing a conductive wire through the opening in the magnetic coupling device;

b) passing a power signal through the wire which, in turn, causes electrical energy to be stored in the system power reservoir of the electronic delay assembly;

c) selecting the desired delay time for the electronic delay assembly;

d) passing a communications signals through the wire with the desired delay encoded therein which, in turn, causes the decoder to supply the desired delay time to the microprocessor;

e) storing the desired delay time in the nonvolatile memory of the microprocessor; and f) communicating the actual stored delay time via the communications link back to the programming unit and repeating steps (d) and (e) if the actual stored delay time does not match the desired delay time; and g) removing the programmed electronic delay assembly from the programming unit after the actual stored delay time matches the desired delay time.

21. The method of claim 20, further including the steps of testing the operation of the trigger switch and discarding any electronic delay assembly which fails this testing.

22. A method of conducting a blasting operation, comprising the steps of:

a) providing the electronic delay assembly of claim 1, with a detonator attached thereto;

b) programming a desired time delay into the electronic delay assembly;

c) passing a conductive wire of a desired length through the programmed electronic delay assembly;

d) installing the programmed electronic delay assembly and attached wire and detonator at a particular location;

e) repeating steps (b) to (d) for each location in a blast site;

f) connecting the wires attached to each electronic delay assembly in a wire loop to a blasting unit;

g) carrying out the detonation of the programmed electronic delay assemblies and attached detonators by means of power and communications signals supplied over the wire loop and through the magnetic coupling device in each electronic delay assembly.

* * * * *